US008311467B2

(12) United States Patent
Yamamoto et al.

(10) Patent No.: US 8,311,467 B2
(45) Date of Patent: Nov. 13, 2012

(54) IMAGE FORMING METHOD

(75) Inventors: Atsushi Yamamoto, Kawanishi (JP); Yoshihiro Fukuhata, Takarazuka (JP); Akira Izutani, Takatsuki (JP)

(73) Assignee: Ricoh Company Limited, Tokyo (JP)

( * ) Notice: Subject to any disclaimer, the term of this patent is extended or adjusted under 35 U.S.C. 154(b) by 203 days.

(21) Appl. No.: 12/762,689

(22) Filed: Apr. 19, 2010

(65) Prior Publication Data

US 2010/0272481 A1 Oct. 28, 2010

(30) Foreign Application Priority Data

Apr. 23, 2009 (JP) ..... 2009-105123

(51) Int. Cl.
*G03G 15/20* (2006.01)
*G03G 15/08* (2006.01)

(52) U.S. Cl. ..... 399/328; 399/333; 399/322; 399/330; 399/331; 430/123.53

(58) Field of Classification Search ..... 399/322, 399/328, 330, 331, 333, 341; 430/123.53
See application file for complete search history.

(56) References Cited

U.S. PATENT DOCUMENTS

| | | | | |
|---|---|---|---|---|
| 7,550,242 | B2 | 6/2009 | Nozaki et al. | |
| 7,556,904 | B2 | 7/2009 | Kadota et al. | |
| 7,635,549 | B2 | 12/2009 | Nakamura et al. | |
| 7,678,522 | B2 | 3/2010 | Nakamura et al. | |
| 7,695,885 | B2 | 4/2010 | Yasunaga et al. | |
| 2002/0051924 | A1 * | 5/2002 | Iida et al. | 430/109.3 |
| 2006/0088779 | A1 * | 4/2006 | Sacripante et al. | 430/108.4 |
| 2007/0026335 | A1 | 2/2007 | Yamamoto et al. | |
| 2007/0059625 | A1 | 3/2007 | Yamamoto et al. | |
| 2007/0166635 | A1 | 7/2007 | Yamamoto et al. | |
| 2007/0207399 | A1 | 9/2007 | Kadota et al. | |
| 2007/0212630 | A1 | 9/2007 | Yasunaga et al. | |
| 2007/0217842 | A1 | 9/2007 | Kato et al. | |
| 2007/0218384 | A1 | 9/2007 | Matsumoto et al. | |
| 2007/0218388 | A1 | 9/2007 | Kurose et al. | |
| 2007/0218393 | A1 | 9/2007 | Nozaki et al. | |

(Continued)

FOREIGN PATENT DOCUMENTS

JP 2-262684 10/1990

(Continued)

OTHER PUBLICATIONS

U.S. Appl. No. 12/686,706, filed Jan. 13, 2010, Yoshihiro Fukuhata.

*Primary Examiner* — Joseph S Wong
(74) *Attorney, Agent, or Firm* — Oblon, Spivak, McClelland, Maier & Neustadt, L.L.P.

(57) ABSTRACT

An image forming method for fixing a toner image on a recording medium by passing the recording medium through a fixing nip defined between a first member and a second member under heat and pressure. The toner has a specific loss elastic modulus. The first and second members extend along respective first and second longitudinal axes, and have respective first and second elastic layers whose thickness vary along the respective first and second longitudinal axes to define at least one convex portion curving outward and at least one concave portion curving inward with respect to each of the respective first and second longitudinal axes. The first convex portion engages the second concave portion and the first concave portion engages the second convex portion, to define the fixing nip therebetween.

12 Claims, 8 Drawing Sheets

U.S. PATENT DOCUMENTS

| | | | |
|---|---|---|---|
| 2008/0032223 | A1 | 2/2008 | Yamamoto et al. |
| 2008/0069617 | A1 | 3/2008 | Matsumoto et al. |
| 2008/0081273 | A1 | 4/2008 | Murakami et al. |
| 2008/0131797 | A1 | 6/2008 | Ishikawa et al. |
| 2008/0176159 | A1 | 7/2008 | Matsumoto et al. |
| 2008/0232857 | A1 | 9/2008 | Matsumoto et al. |
| 2009/0186289 | A1 | 7/2009 | Nakamura et al. |
| 2009/0232542 | A1 | 9/2009 | Yamamoto et al. |
| 2009/0233199 | A1 | 9/2009 | Nozaki et al. |
| 2009/0297975 | A1 | 12/2009 | Ishikawa et al. |
| 2009/0297976 | A1 | 12/2009 | Yamamoto et al. |
| 2010/0055603 | A1 | 3/2010 | Nozaki et al. |
| 2010/0068646 | A1 | 3/2010 | Yamamoto |

FOREIGN PATENT DOCUMENTS

| | | |
|---|---|---|
| JP | 7-129014 | 5/1995 |
| JP | 3119405 | 10/2000 |
| JP | 2001-265146 | 9/2001 |
| JP | 3267416 | 1/2002 |
| JP | 2005-284089 | 10/2005 |
| JP | 2005-352297 | 12/2005 |
| JP | 2007-279689 | 10/2007 |
| JP | 2008-20821 | 1/2008 |
| JP | 2008-268353 | 11/2008 |

* cited by examiner

IMAGE FORMING METHOD

CROSS-REFERENCE TO RELATED APPLICATIONS

This document claims priority from and contains subject matter related to Japanese Patent Application No. 2009-105123, filed on Apr. 23, 2009, the entire contents of which are hereby incorporated herein by reference.

BACKGROUND

1. Field of the Invention

The present invention relates to an image forming method for fixing a toner image in place on a recording medium with heat and pressure, which is applicable to electrophotographic image forming apparatuses such as copiers, printers, and facsimile machines.

2. Description of the Background

When toner particles adhering to the entire surface of a thin paper, from the leading end to the rear end, are fixed thereon in a fixing device of an electrophotographic printing apparatus, disadvantageously, the thin paper is likely to get jammed in the fixing device or wraparound a fixing member.

To prevent such paper jam or wraparound and facilitate separation of the paper from the fixing member, one proposed approach involves reducing the diameter of the fixing member to increase the curvature thereof. Another approach involves applying an oil to the fixing member to provide a release layer between the fixing member and toner particles. Further, another approach involves including a release agent (e.g., a wax) in toner particles.

As another approach, Japanese Patent Application Publication Nos. 2008-20821, 2005-284089, and 2001-265146 each disclose a fixing device including a fuser roller and a pressure roller each having 2 or more convex and concave portions in the axial direction. A fixing nip is defined by engaging the convex portions of the fuser roller and the concave portions of the pressure roller, and engaging the concave portions of the fuser roller and the convex portions of the pressure roller.

However, such a fixing device does not solve the problem of paper jam or paper wraparound when a recording medium is a thin paper or toner particles are adhering to the entire surface of the recording medium from the leading end to the rear end.

On the other hand, the above fixing devices do not have any problem in image gloss. Although the gloss of the first resulting image and that of succeeding resulting images may be slightly different due to decrease of the fuser roller temperature, the gloss is uniform throughout the entire resulting image because the entire surfaces of both the fuser and pressure rollers have a constant temperature.

SUMMARY

Exemplary aspects of the present invention are put forward in view of the above-described circumstances, and provide a novel image forming method which provides high-quality images without causing paper jam or paper wrapping around fixing members.

In one exemplary embodiment, the novel image forming method includes forming a toner image on a recording medium with a toner comprising a resin and a colorant, and fixing the toner image on the recording medium by passing the recording medium through a fixing nip defined between a first member and second member under heat and pressure. A loss elastic modulus at 100° C. (G"(100)) of the toner is less than 80,000 Pa·s, and a ratio (G"(100)/G"(150)) of the loss elastic modulus at 100° C. (G"(100)) to a loss elastic modulus at 150° C. (G"(150)) of the toner is from 1 to 20. The first member extends along a first longitudinal axis, and has a first elastic layer whose thickness varies along the first longitudinal axis to define at least one first convex portion curving outward and at least one first concave portion curving inward with respect to the first longitudinal axis. The second member extends along a second longitudinal axis, and has a second elastic layer whose thickness varies along the second longitudinal axis to define at least one second convex portion curving outward and at least one second concave portion curving inward with respect to the second longitudinal axis. At least one of the first and second members is heated, and at least one of the first and second members is pressed against the other, with the first convex portion engaging the second concave portion and the first concave portion engaging the second convex portion, to define the fixing nip therebetween.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
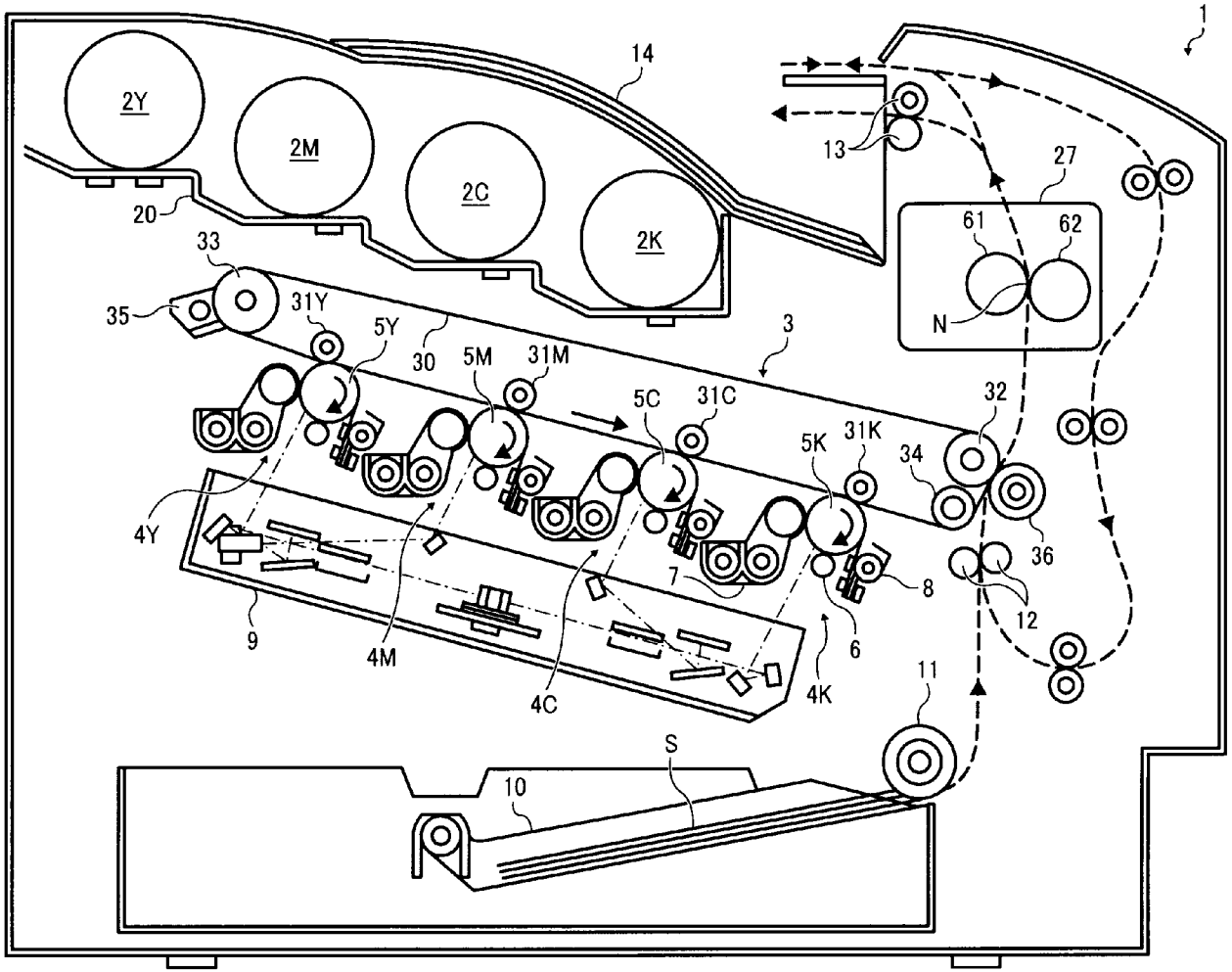
FIG. 1 schematically illustrates an example of an image forming apparatus for processing an image forming method according to this patent specification.

In attempting to facilitate separation of a recording sheet, especially a thin paper, from a fixing member, there is an approach to improve flexural stiffness of the recording sheet. For example, a related art fixing device includes a fuser roller having convex and concave potions that defines an undulating surface and a pressure roller having convex and concave potions that defines an undulating surface, to improve flexural stiffness of a recording sheet that passed through the fixing nip defined between the fuser roller and the pressure roller.

Specifically, passing a recording sheet through the fixing nip during the fixing process causes the sheet to conform to the undulating surfaces of the fuser and pressure rollers. As the sheet thus becomes undulated and corrugated, it temporarily exhibits an apparent stiffness greater than that exhibited without corrugation. Such temporary stiffing effect allows the recording sheet to advance past the fixing nip without wrapping around the fuser roller and causing a jam at the fixing nip, even when the sheet in use is relatively thin and ready to bend due to adhesion of molten toner to the surface of the fuser roller.

However, such a fixing device is likely to cause gloss difference in a stripe pattern with respect to the direction of feed of the recording sheet.

One possible reason for this is considered as follows. When the fuser roller is heated, the surface temperature becomes different between the convex portion and the concave portion. Specifically, the concave portion defined by a thin elastic layer has a higher surface temperature than the convex portion defined by a thick elastic layer because thermal conductivity is different therebetween, while a metal shaft of the fuser roller has a uniform thickness in the axial direction. Therefore, toner particles which pass through the concave portions of the fuser roller receive more heat than toner particles which pass through the convex portions of the fuser roller. The former results in a high gloss image, and the latter results in a low gloss image. Thus, stripe-patterned gloss difference is generated.

In view of this situation, the present specification provides an image forming method which provides images with uniform gloss by controlling viscoelasticity of toner in use.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent specification are described.

FIG. 1 schematically illustrates an example of an image forming apparatus 1 incorporating a fixing device 27 according to this patent specification.

As shown in FIG. 1, the image forming apparatus 1 is a tandem color printer including four imaging units 4Y, 4M, 4C, and 4K arranged in series along the length of an intermediate transfer unit 3 and adjacent to a write scanner 9, which together form an electrophotographic mechanism to form an image with toner particles on a recording medium such as a sheet of paper S. The image forming apparatus 1 also includes a feed roller 11, a pair of registration rollers 12, and a pair of ejection rollers 13 together defining a sheet feed path, indicated by dotted arrows in the drawing, along which a recording sheet S advances toward an output tray 14 atop the apparatus 1 from a sheet feed tray 10 accommodating a stack of recording sheets at the bottom of the apparatus 1 through the fixing device 27 according to this patent specification.

In the image forming apparatus 1, each imaging unit (indicated collectively by the reference numeral 4) has a drum-shaped photoconductor 5 surrounded by a charging device 6, a development device 7, a cleaning device 8, a discharging device, not shown, etc., which work in cooperation to form a toner image of a particularly primary color, as designated by the suffix letters, "Y" for yellow, "M" for magenta, "C" for cyan, and "K" for black. The imaging units 4Y, 4M, 4C, and 4K are supplied with toner from replaceable toner bottles 2Y, 2M, 2C, and 2K, respectively, accommodated in a toner supply 20 in the upper portion of the apparatus 1.

The intermediate transfer unit 3 includes an intermediate transfer belt 30, four primary transfer rollers 31Y, 31M, 31C, and 31K, and a belt cleaner 35, as well as a transfer backup roller or drive roller 32, a cleaning backup roller 33, and a tension roller 34 around which the intermediate transfer belt 30 is entrained. When driven by the roller 32, the intermediate transfer belt 30 travels counterclockwise in the drawing along an endless travel path, passing through four primary transfer nips defined between the primary transfer rollers 31 and the corresponding photoconductor 5, as well as a secondary transfer nip defined between the transfer backup roller 32 and transfer roller 36.

The fixing device 27 includes a pair of first and second fixing members 61 and 62, one being heated and the other being pressed against the heated one, to form a fixing nip N therebetween in the sheet feed path. Detailed description of several embodiments of the fixing device 27 according to this patent specification will be given with reference to FIG. 2 and subsequent drawings.

During operation, each imaging unit 4 rotates the photoconductor 5 clockwise in the drawing to forward its outer, photoconductive surface to a series of electrophotographic processes, including charging, exposure, development, transfer, and cleaning, in one rotation of the photoconductor 5.

First, the photoconductive surface is uniformly charged by the charging device 6 and subsequently exposed to a modulated laser beam emitted from the write scanner 9. The laser exposure selectively dissipates the charge on the photoconductive surface to form an electrostatic latent image thereon according to image data representing a particular primary color. Then, the latent image enters the development device 7 which renders the incoming image into visible form using toner. The toner image thus obtained is forwarded to the primary transfer nip between the intermediate transfer belt 30 and the primary transfer roller 31.

At the primary transfer nip, the primary transfer roller 31 applies a bias voltage of polarity opposite that of toner to the intermediate transfer belt 30. This electrostatically transfers the toner image from the photoconductive surface to an outer surface of the belt 30, with a certain small amount of residual toner particles left on the photoconductive surface. Such transfer process occurs sequentially at the four transfer nips along the belt travel path, so that toner images of different colors are superimposed one atop another to form a multicolor image on the surface of the intermediate transfer belt 30.

After primary transfer, the photoconductive surface enters the cleaning device 8 to remove residual toner by scraping off with a cleaning blade, and then to the discharge device to remove residual charges for completion of one imaging cycle. At the same time, the intermediate transfer belt 30 forwards the multicolor image to the secondary transfer nip between the transfer backup roller 32 and the secondary transfer roller 36.

In the sheet feed path, the feed roller 11 rotates counterclockwise in the drawing to introduce a recording sheet S from the sheet feed tray 10 toward the pair of registration rollers 12. The registration rollers 12 hold the fed sheet S, and then advance it in sync with the movement of the intermediate transfer belt 30 to the secondary transfer nip. At the secondary transfer nip, the multicolor image is transferred from the belt 30 to the incoming sheet S, with a certain small amount of residual toner particles left on the belt surface.

After secondary transfer, the intermediate transfer belt 30 enters the belt cleaner 35, which removes and collects residual toner from the intermediate transfer belt 30. At the same time, the recording sheet S bearing the powder toner image thereon is introduced into the fixing device 27, which fixed the multicolor image in place on the recording sheet S with heat and pressure through the fixing nip N.

Thereafter, the recording sheet S is ejected by the ejection rollers 13 to the output tray 14 to complete one operational cycle of the image forming apparatus 1.

Embodiment 1

Figure 2:
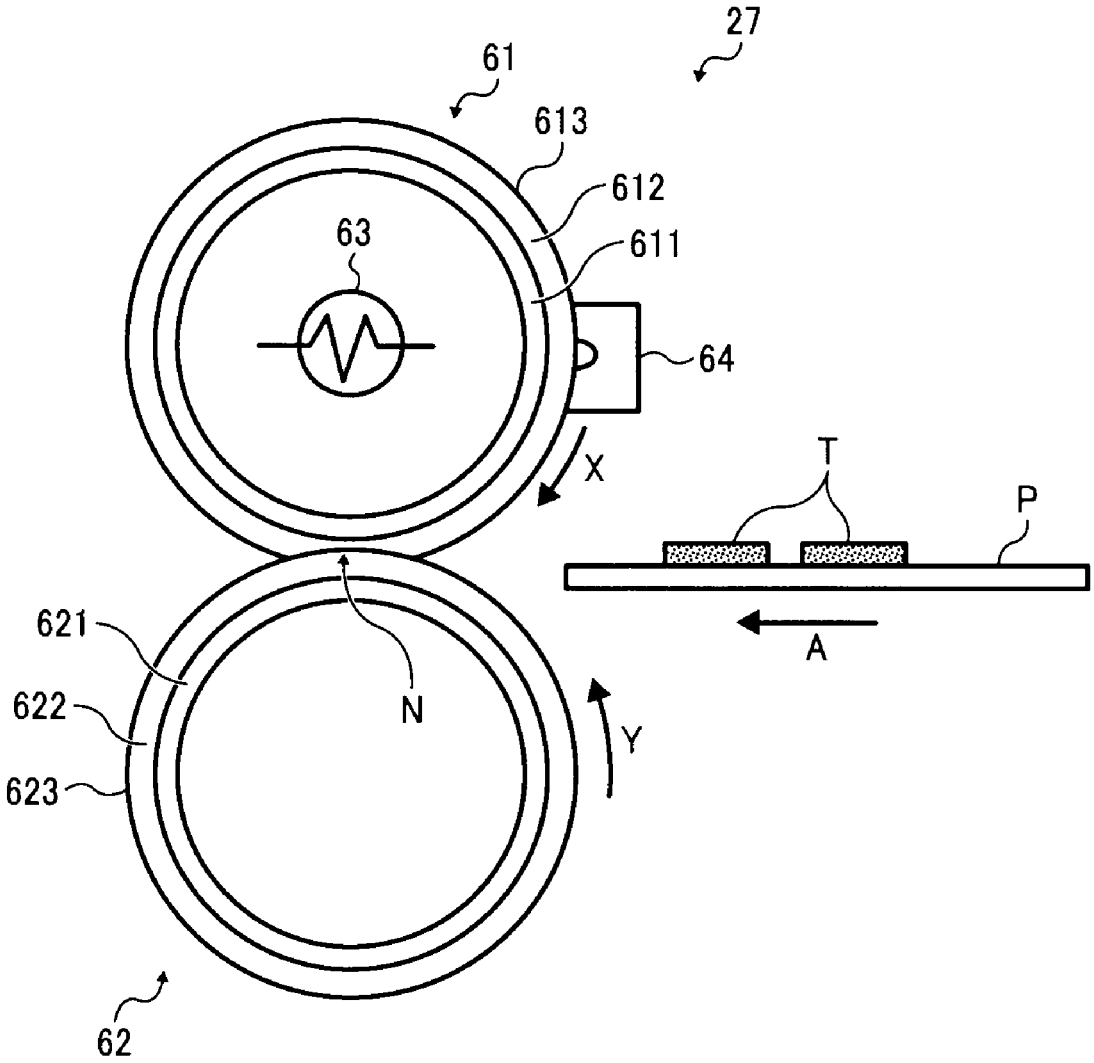
FIG. 2 is an end-on, axial view schematically illustrating one embodiment of the fixing device incorporated in the image forming apparatus of FIG. 1.

FIG. 2 is an end-on, axial view schematically illustrating one embodiment of the fixing device 27 incorporated in the image forming apparatus 1.

As shown in FIG. 2, in the present embodiment of the fixing device 27, the first fixing member comprises a fuser roller 61 extending along a longitudinal axis thereof, and the second fixing member comprises a pressure roller 62 extending along a longitudinal axis thereof. The fuser roller 61 and the pressure roller 62 can rotate around their respective longitudinal axes, while contacting each other with the longitudinal axes generally parallel to form a fixing nip N therebetween.

The fuser roller 61 is formed of a hollow, cylindrical metal core 611 covered by a layer of elastic material 612 with a coating of release agent 613 applied to an outer surface of the elastic layer 612. The fuser roller 61 has a heat source such as a lamp heater 63 extending along the longitudinal axis to heat the roller body from within, as well as a thermometer 64 to sense temperature of the roller outer surface. The heater 63 and the thermometer 64 are connected to a controller, not shown, which controls the heater 63 according to readings of the thermometer 64 to maintain the temperature of the outer surface at a given processing temperature.

Similarly, the pressure roller 62 is formed of a hollow, cylindrical metal core 621 covered by a layer of elastic material 622 with a coating of release agent 623 applied to an outer surface of the elastic layer 622. The pressure roller 62 has a biasing mechanism, not shown, that presses the pressure roller 62 against the fuser roller 61.

During operation, the fixing device 27 rotates the fuser roller 61 in the direction of arrow X and the pressure roller 62 in the direction of arrow Y to feed a recording sheet S bearing a toner image T thereon in the direction of arrow A. At the same time, the fixing device 27 heats the outer surface of the fuser roller 61 to a temperature sufficient to melt the toner particles. As the sheet S enters the fixing nip N, the toner image T comes into contact with the heated surface of the fuser roller 61. At the fixing nip N, the fuser roller 61 melts the toner particles with heat, while the pressure roller 62 promotes settling of the molten toner by pressing the sheet S against the fuser roller 61. The toner image T thus processed under heat and pressure then cools and solidifies and becomes fixed in place as the sheet S leaves the fixing nip N to advance along the sheet feed path A.

Figure 3:
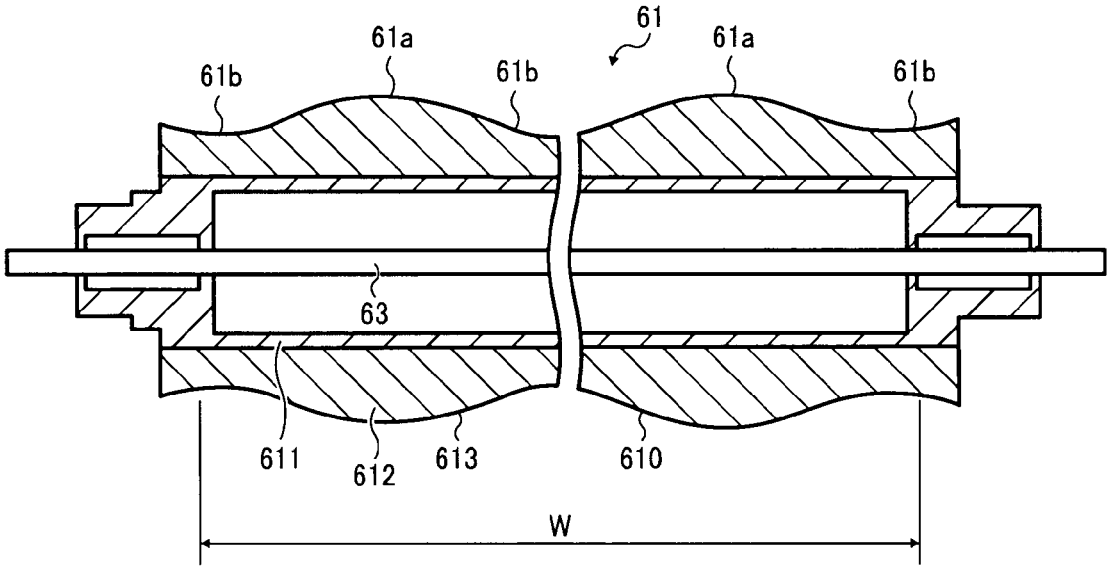
FIG. 3 schematically illustrates a fuser roller used in the fixing device of FIG. 2 along the longitudinal axis in transverse cross-section.

FIG. 3 schematically illustrates the fuser roller 61 along the longitudinal axis in transverse cross-section.

As shown in FIG. 3, the fuser roller 61 has an alternating series of at least one convex portion 61*a* curving outward and at least one concave portion 61*b* curving inward with respect to the longitudinal axis to define an undulating outer peripheral surface 610.

The convex and concave portions 61*a* and 61*b* are formed by varying the thickness of the elastic layer 612, with the metal core 611 and the release coating 613 each having a substantially uniform thickness or cross-section along the longitudinal axis.

The elastic layer 612 may be formed by fitting an elastic cylindrical tube or applying an elastic material to the metal core 611 to form an undulating peripheral surface. Similarly, the release layer 613 may be formed by fitting a release cylindrical tube or applying a release material to the undulating peripheral surface of the elastic layer 612.

Each of the convex and concave portions 61*a* and 61*b* has a height with respect to a circumferential plane of the roller 61 in a range of, for example, approximately 0.1 mm to approximately 0.5 mm, and a width along the longitudinal axis of the roller 61 of, for example, approximately 10 mm. The number of convex portions 61*a* and concave portions 61*b* each may be any number equal to or greater than one.

In the present embodiment, the convex portion 61*a* and the concave portion 61*b* are contiguous to each other so that the roller surface 610 as a whole has a continuously undulating configuration, such as a sinusoidal curve or other suitable curve. A series of convex and concave portions 61*a* and 61*b* spans a width W indicating a maximum compatible sheet width of recording medium that the fixing device 27 can accommodate in the fixing nip N. Alternatively, the curving portions 61*a* and 61*b* may be present only over a portion of the maximum compatible sheet width W.

Figure 4:
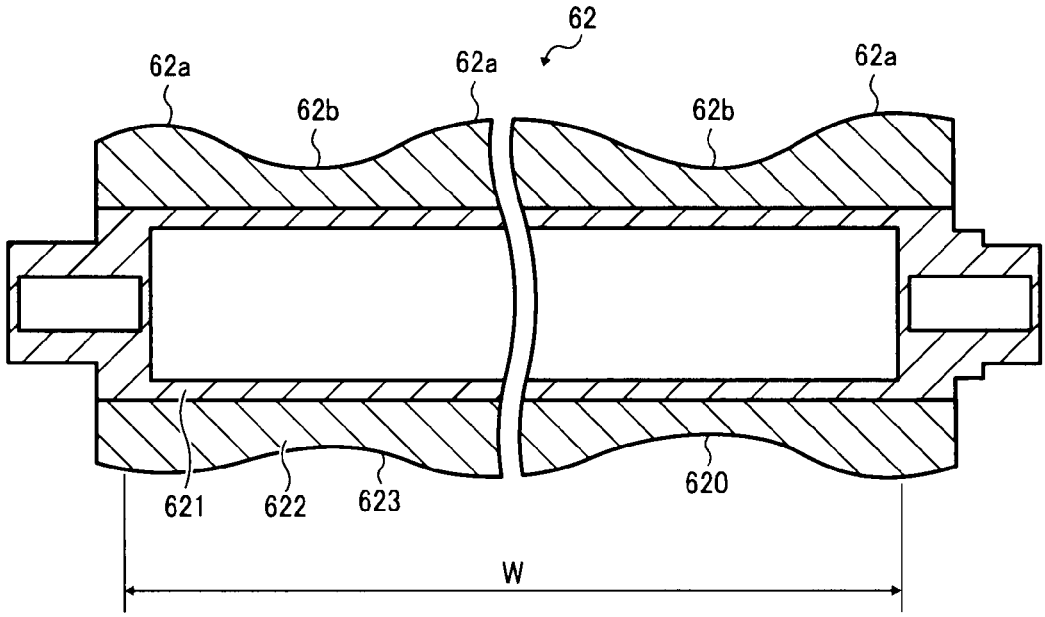
FIG. 4 schematically illustrates a pressure roller used in the fixing device of FIG. 2 along the longitudinal axis in transverse cross-section.

FIG. 4 schematically illustrates the pressure roller 62 along the longitudinal axis in transverse cross-section.

As shown in FIG. 4, the pressure roller 62 has an alternating series of at least one convex portion 62*a* curving outward and at least one concave portion 62*b* curving inward with respect to the longitudinal axis to define an undulating outer peripheral surface 620.

The convex and concave portions 62*a* and 62*b* are formed by varying the thickness of the elastic layer 622, with the metal core 621 and the release coating 623 each having a substantially uniform thickness or cross-section along the longitudinal axis.

The elastic layer 622 may be formed by fitting an elastic cylindrical tube or applying an elastic material to the metal core 621 to form an undulating peripheral surface. Similarly, the release layer 623 may be formed by fitting a release cylindrical tube or applying a release material to the undulating peripheral surface of the elastic layer 622.

Each of the convex and concave portions 62*a* and 62*b* has a height with respect to a circumferential plane of the roller 62 in a range of, for example, approximately 0.1 mm to approximately 0.5 mm, and a width along the longitudinal axis of the roller 62 of, for example, approximately 10 mm. The number of convex portions 62*a* and concave portions 62*b* each may be any number equal to or greater than one.

In the present embodiment, as in the case of the fuser roller 61, the convex portion 62*a* and the concave portion 62*b* are contiguous to each other so that the roller surface 620 as a whole has a continuously undulating configuration, such as a sinusoidal curve or other suitable curve, and a series of convex and concave portions 62*a* and 62*b* of the pressure roller 62 may span all or part of the maximum compatible sheet width W.

In the fixing device 27, the fuser roller 61 has the same number of convex portions 61*a* as the number of concave portions 62*b* of the pressure roller 62, and the pressure roller 62 has the same number of convex portions 62*a* as the number of concave portions 61*b* of the fuser roller 61. The convex portions 61*a* of the fuser roller 61 are similar in dimension and position, and preferably, complementary in shape, to the concave portions 62*b* of the pressure roller 62 in the axial direction, and the convex portions 62*a* of the pressure roller 62 are similar in dimension and position, and preferably, complementary in shape, to the concave portions 61*b* of the fuser roller 61 in the axial direction. Such configuration of the fuser and pressure rollers 61 and 62 allows engagement and close contact between their undulating surfaces 610 and 620 by fitting the corresponding convex and concave portions when mounted in the fixing device 27 as described in detail with reference to FIG. 5.

Figure 5:
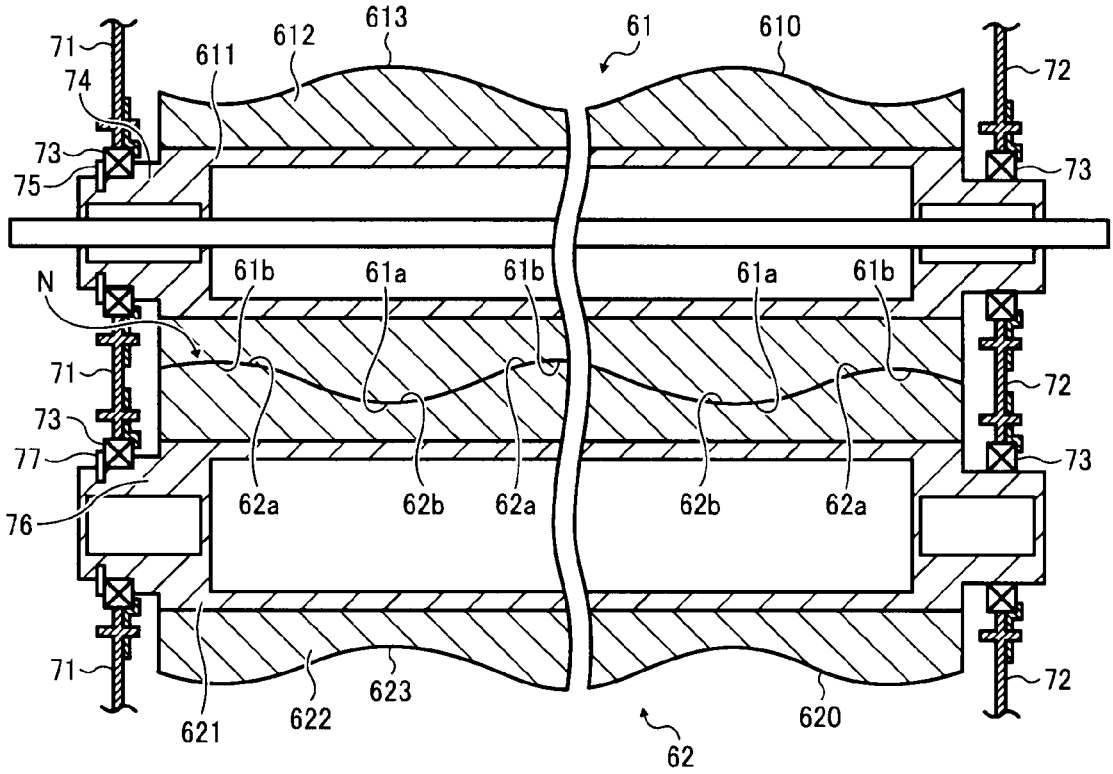
FIG. 5 shows the fuser roller and the pressure roller mounted in the fixing device of FIG. 2.

FIG. 5 shows the fuser roller 61 and the pressure roller 62 mounted in the fixing device 27, with the biasing mechanism of the pressure roller 62 being omitted for clarity.

As shown in FIG. 5, the fixing device 27 accommodates the fuser roller 61 and the pressure roller 62 between a pair of parallel left and right sidewalls 71 and 72 for installation in the image forming apparatus 1. When properly mounted, the rollers 61 and 62 have their cylindrical metal cores 611 and 621 uniformly spaced apart from each other and their undulating surfaces 610 and 620 engaged in pressure contact with each other along the fixing nip N, with each convex portion 61*a* of the fuser roller 61 fitting in the corresponding concave portion 62*b* of the pressure roller 62, and each convex portion 62*a* of the pressure roller 62 fitting in the corresponding concave portion 61*b* of the fuser roller 61.

In such a configuration, the fixing device 27 according to this patent specification can temporarily stiffen a recording sheet S during passage through the fixing nip N, so as to reliably feed the sheet S without wrapping the sheet S around the fuser roller 61 even when the sheet S in use is relatively thin and consequently ready to bend and deviate from the proper feed path.

Specifically, with additional reference to FIG. 2, passing a recording sheet S through the fixing nip N during the fixing process causes the sheet S to conform to the undulating surfaces 610 and 620 of the fuser and pressure rollers 61 and 62. As the sheet S thus becomes undulated and corrugated, it temporarily exhibits an apparent stiffness greater than that exhibited without corrugation. Such temporary stiffing effect allows the recording sheet S to advance past the fixing nip N without wrapping around the fuser roller 61 and causing a jam at the fixing nip N, even when the sheet S in use is relatively thin and ready to bend due to adhesion of molten toner to the surface of the fuser roller 61.

Moreover, the fixing device 27 according to this patent specification can maintain a uniform pressure distribution throughout the fixing nip N to provide fixing with uniform gloss across a resulting image.

Specifically, the fuser and pressure rollers 61 and 62 contact each other at substantially uniform pressure along the fixing nip N owing to the engagement between the undulating surfaces 610 and 620 provided by fitting the corresponding convex and concave portions together. Since gloss of an image printed on a recording medium depends on the pressure applied to the recording medium during fixing, the uniform nip pressure exerted on the recording sheet S during passage through the fixing nip N provides uniform gloss across the image T.

Some conventional fixing devices use a precisely cylindrical fixing roller in conjunction with an axially tapered, symmetrical fixing roller that has a diameter greatest at the center and smallest at each end ("crowned"), or conversely, greatest at each end and smallest at the center ("bowed"). In contrast to the undulating fixing rollers 61 and 62 according to this patent specification, the conventional combination of cylindrical and tapered rollers often results in variation in nip pressure, since they contact each other at higher pressures where tapered roller diameter is greatest and at lower pressures where the tapered roller diameter is smallest. Such higher and lower pressure present along the fixing nip translate into areas of higher and lower gloss appearing in a resulting image, which is not acceptable for applications in today's high quality image forming apparatus.

Furthermore, the fixing device 27 according to this patent specification can maintain the undulating roller surfaces 610 and 620 in proper engagement with each other, thus ensuring uniform pressure distribution across the fixing nip N after installation of the fixing device 27.

Specifically, with continued reference to FIG. 5, the fuser roller 61 is mounted for rotation around the longitudinal axis with a pair of bearings 73 (e.g., ball bearings) one on each of the sidewalls 71 and 72. The bearing 73 on the left sidewall 71 is secured to the roller 61 by fitting between a flange 74 and a retaining ring 75 provided on the roller end, whereas the bearing 73 on the right sidewall 72 is not secured to the roller 61, thus allowing displacement of the fuser roller 61 with respect to the right sidewall 72 but not to the left sidewall 71 along the longitudinal axis.

Similarly, the pressure roller 62 is mounted for rotation around the longitudinal axis with a pair of bearings 73 (e.g., ball bearings) one on each of the sidewalls 71 and 72. The bearing 73 on the left sidewall 71 is secured to the roller 61 by fitting between a flange 76 and a retaining ring 77 provided on the roller end, whereas the bearing 73 on the right sidewall 72 is not secured to the roller 62, thus allowing displacement of the fuser roller 61 with respect to the right sidewall 72 but not to the left sidewall 71 along the longitudinal axis.

Thus, the fixing rollers 61 and 62 are mounted in the fixing device 27 with one end (in this case the left end) secured to the left sidewall 71 and the other end (in this case the right end) displaceable in the axial direction. Consequently, when the rollers 61 and 62 expand along their respective longitudinal axes by being heated to processing temperature during operation, they elongate solely on the right side while maintaining their left ends aligned with each other. This reduces the risk of misaligning corresponding concave and convex portions of the rollers 61 and 62 after installation of the fixing device 27, which would otherwise detract from uniform nip pressure and from uniform gloss of a resulting image.

The side on which rollers 61 and 62 are fixed or displaceable may be different than that depicted in FIG. 5, as long as the rollers 61 and 62 have one pair of adjacent longitudinal ends positioned in alignment with each other, and the other pair of adjacent longitudinal ends displaceable along the respective longitudinal axes. That is, the fixing rollers 61 and 62 may be mounted with their respective right ends secured to the right sidewall 72 and their respective left ends displaceable in the axial direction, in which case the rollers 61 and 62 can elongate solely on the left side while maintaining their right ends aligned with each other during operation.

Preferably, the convex portion 61*a* of the fuser roller 61 and the concave portion 62*b* of the pressure roller 62 have complementary shapes, and the convex portion 62*a* of the pressure roller 62 and the concave portion 61*b* of the fuser roller 61 have complementary shapes, so that the fuser and pressure rollers 61 and 62 establish close contact with each other with no space between the undulating surfaces 610 and 620 at least over the maximum compatible sheet width W under no-load conditions, i.e., when no force is applied to press the pressure roller 62 against the fuser roller 61.

For example, where one of the undulating surfaces 610 and 620 defines a sinusoidal curve of a given amplitude and frequency, it is desirable that the other one of the surfaces 610 and 620 defines a sinusoidal curve of the same amplitude and frequency to provide uniform close contact therebetween under no load condition. In this case, when plotted against the position along the longitudinal axes, the thicknesses of the elastic layers 612 and 622 trace a pair of sinusoidal waveforms opposite in phase and identical in amplitude and frequency with respect to each other.

Establishing close contact between the rollers 61 and 62 under no-load conditions ensures good imaging performance of the fixing device 27, since any space left between the roller surfaces 610 and 620 would result in variation in pressure along the fixing nip N under load condition, i.e., when the pressure roller 62 is pressed against the fixing roller 61 upon mounting to the fixing device.

Further, preferably, the total thickness of the elastic layers 612 and 622 present between the rollers 61 and 62 is constant at every point along the fixing nip N when the rollers 61 and 62 contact each other under no-load conditions. This also ensures good imaging performance of the fixing device 27, since pressure at a specific point along the fixing nip N is substantially dependent on the amount of the elastic material present between the metal cores 611 and 621 which are uniformly spaced from each other, so that variation in the total thickness of the elastic layers 612 and 622 under no-load conditions would result in variation in nip pressure under load conditions.

Still further, preferably, the convex and concave portions of the fixing rollers 61 and 62 are contiguous to each other as in the embodiment depicted in FIGS. 3 through 5. This ensures good sheet feeding performance of the fixing device 27, since providing convex and concave portions at intervals would increase the risk of wrinkling on a recording sheet corrugated between the undulating surfaces during passage through the fixing nip N.

Figure 6:
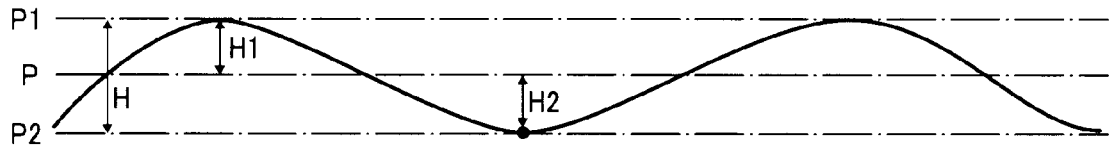
FIG. 6 shows a portion of an undulating surface of the fixing member used in the fixing device according to this patent specification.

FIG. 6 shows a portion of the undulating surface of the fixing member used in the fixing device 27 according to this patent specification, in which an imaginary line "P" represents a reference peripheral plane parallel to the longitudinal axis of the fixing member, "P1" represents an outer peripheral plane defined by apices of the convex portions, and "P2" represents an inner peripheral plane defined by apices of the concave portions.

As shown in FIG. 6, the undulating surface has an amplitude of undulation H defined as a total of H1 and H2, with H1 representing a distance from the outer peripheral plane P1 to the reference plane P (i.e., the height of convex portion), and H2 representing a distance from the inner peripheral plane P2 to the reference plane P (i.e., the height of concave portion). In the present embodiment, the reference plane P is equidistant from the outer and inner planes P1 and P2, so that the curve heights H1 and H2 are equal to half the undulation amplitude H. The values of H1, H2, and H may be established experimentally, so as to effect good sheet feeding and image fixing performance of the fixing device 27 according to the specific application.

Preferably, the amplitude H of the undulating surface is in a range of approximately 0.16 mm to approximately 0.8 mm in the fixing nip N. Experiments have shown an undulation amplitude H smaller than 0.16 mm results in an insufficient amount of curvature of a recording sheet corrugated by passing through the fixing nip N, meaning insufficient sheet stiffening effect of the undulating fixing members, whereas an undulation amplitude H greater than 0.8 mm results in a significant inconsistency in rotational speed at convex and concave portions of the rollers, which can wrinkle a recording sheet passing through the fixing nip N.

Since the elastic layer is compressed at a certain compression ratio under pressure within the fixing nip N, the undulation amplitude H varies depending on whether the fixing member is under load condition or no load condition.

For example, the elastic layers 612 and 622 of the fixing rollers 61 and 62 may be compressed to approximately 80% of their original thicknesses (i.e., at a compression ratio of approximately 20% or less) under load conditions, in which case the undulation amplitude H outside the fixing nip N is approximately 1.25 times greater than that within the fixing nip. Using a compression ratio exceeding 20% is undesirable since it can develop plastic deformation of the material constituting the elastic layer, leading to noises generated during operation, imperfection in resulting images, and other malfunctions of the fixing device 27.

Where the elastic layers 612 and 622 are compressed at a compression ratio of approximately 20%, the amplitude H of the undulating roller surfaces 610 and 620 may be in a range of approximately 0.16 mm to approximately 0.8 mm under load condition, and in a range of approximately 0.2 mm to approximately 1 mm (equivalent to curve heights H1 and H2 ranging from approximately 0.1 mm to approximately 0.5 mm) under no-load conditions.

Embodiment 2

Figure 7:
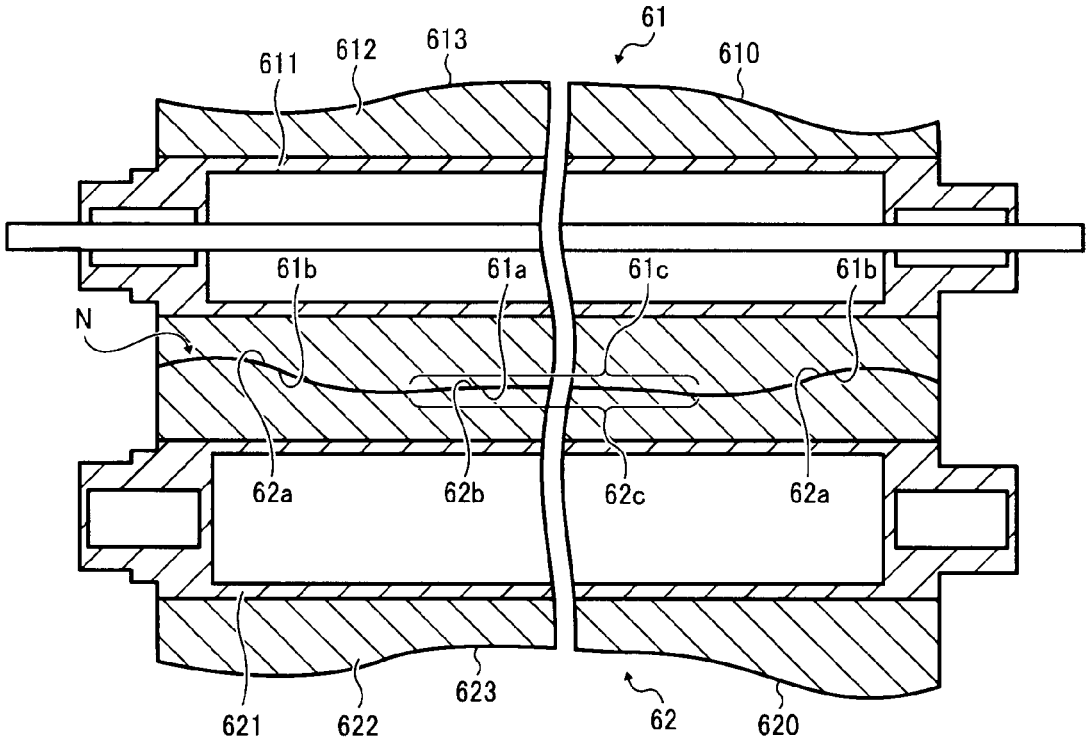
FIGS. 7 and 8 are an end-on, axial views schematically illustrating other embodiments of the fixing device incorporated in the image forming apparatus of FIG. 1.
Figure 8:
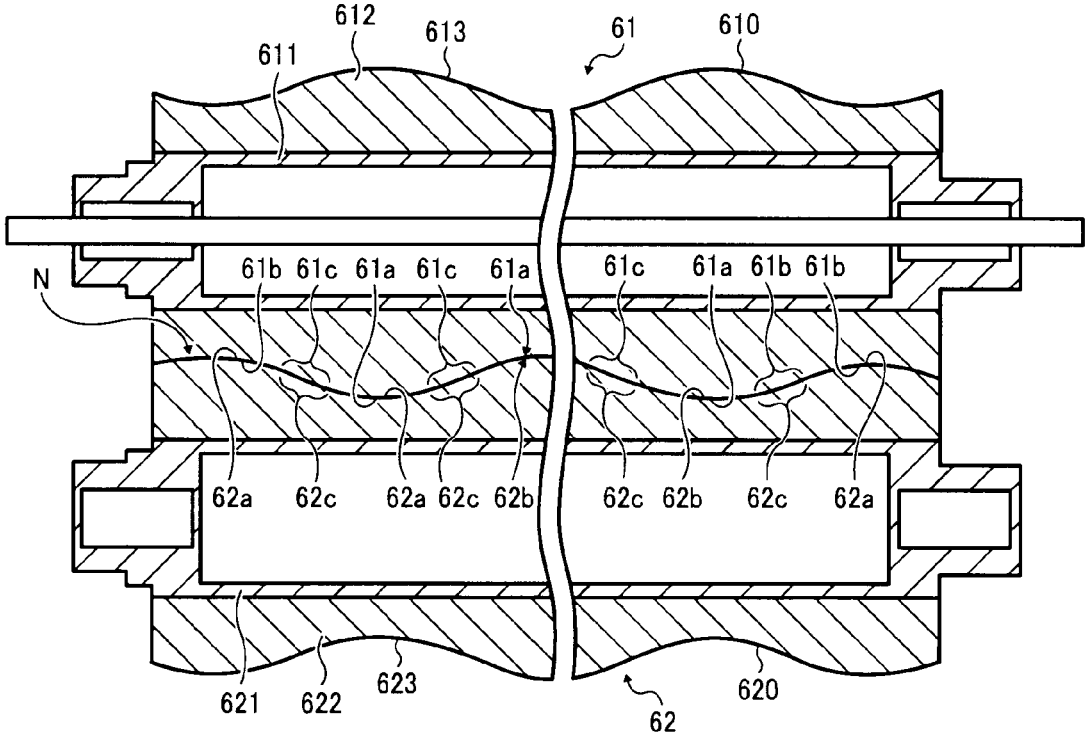

In further embodiments, the undulating fixing rollers 61 and 62 may have other configurations than that depicted in FIGS. 3 to 5, wherein each roller has convex and/or concave portions that are partially straight, i.e., exhibiting substantially no curvature, in the axial direction. FIGS. 7 and 8 show examples of such configurations.

As shown in FIG. 7, the convex portion 61*a* of the fuser roller 61 may have a flat apex 61*c* that has a profile parallel to the longitudinal axis of the roller 61 and exhibits substantially no curvature in the axial direction, and the concave portion 62*b* of the pressure roller 62 may have a flat apex 62*c* that has a profile parallel to the longitudinal axis of the roller 62 and exhibits substantially no curvature in the axial direction. The flat portions 61*c* and 62*c* are formed without sharp edges or corners on their perimeters, so that the undulating surfaces 61 and 62 are generally smooth and continuous across the fixing nip N.

Alternatively, as shown in FIG. 8, the convex and concave portions 61*a* and 61*b* of the fuser roller 61 may have a flat taper 61*d* therebetween that has a profile diagonal to the longitudinal axis of the roller 61 and exhibits substantially no curvature in the axial direction, and the convex and concave portions 62*a* and 62*b* of the pressure roller 62 may have a flat taper 62*d* therebetween that has a profile diagonal to the longitudinal axis of the roller 62 and exhibits substantially no curvature in the axial direction. The flat portions 61*d* and 62*d* are formed without sharp edges or corners on their perimeters, so that the undulating surfaces 61 and 62 are generally smooth and continuous across the fixing nip N.

Except for the flat portions forming part of or connecting with the convex and concave portions, the embodiments depicted in FIGS. 7 and 8 include features identical to those depicted in the embodiment of FIG. 5, such as the undulating roller surfaces formed by varying the thicknesses of the elastic layers and the mounting mechanism for ensuring engagement of the undulating surfaces, of which further description is omitted for brevity.

Embodiment 3

Figure 9:
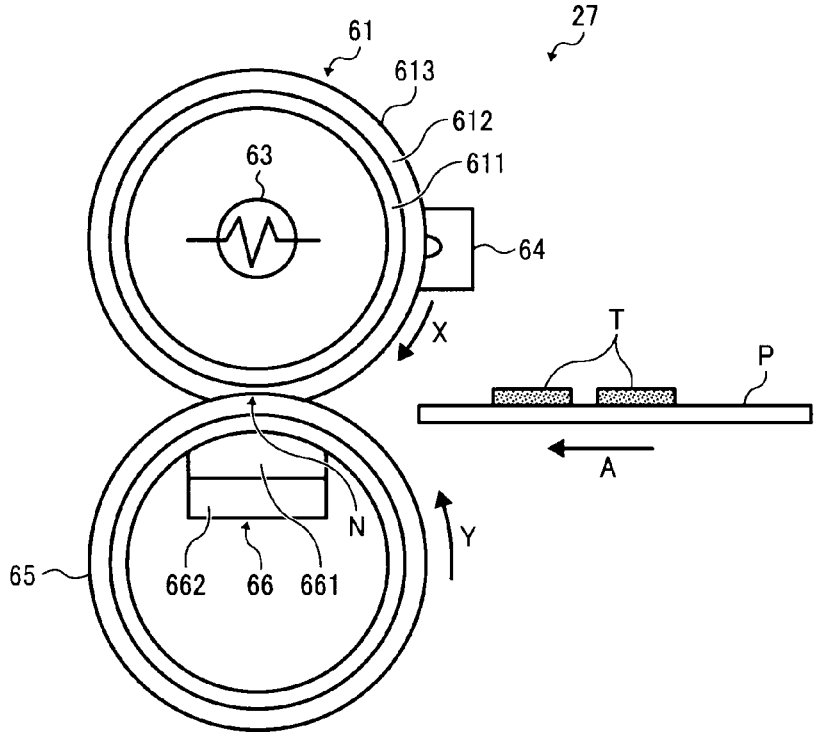
FIG. 9 is an end-on, axial view schematically illustrating further embodiment of the fixing device incorporated in the image forming apparatus of FIG. 1.

FIG. 9 is an end-on, axial view schematically illustrating another embodiment of the fixing device 27 incorporated in the image forming apparatus 1.

As shown in FIG. 9, the present embodiment is similar to that depicted in FIG. 2, except that the pressure roller 62 is replaced by a stationary pressure member 66 pressed against the fuser roller 61 through a fixing belt 65. The fuser roller 61 can rotate around the longitudinal axis while contacting the pressure member 66 to define a fixing nip N therebetween, through which the fixing belt 65 rotates around the pressure member 66 upon rotation of the fuser roller 61.

The fuser roller 61 is configured in a manner similar to that depicted above, formed of the hollow, cylindrical metal core 611 covered by the layer of elastic material 612 with the coating of release agent 613 applied to the outer surface of the elastic layer 612, and having the lamp heater 63 and the thermometer 64 to control temperature of the outer surface.

The pressure member 66 is formed of a substantially flat, planar substrate 662 covered by a layer 661 of elastic material such as silicone rubber. The pressure member 66 has a biasing mechanism, not shown, that presses the pressure member 66 against the fuser roller 61 through the fixing belt 65.

The fixing belt 65 comprises an endless smooth belt formed of a suitable flexible material such as a polyimide film and loosely looped around the pressure member 66 without constricting the pressure member 66.

During operation, the fixing device 27 rotates the fuser roller 61 in the direction of arrow X and the fixing belt 65 in the direction of arrow Y to feed a recording sheet S bearing a powder toner image T thereon in the direction of arrow A. At the same time, the fixing device 27 heats the outer surface of the fuser roller 61 to a processing temperature sufficient to melt the toner particles. As the sheet S enters the fixing nip N, the toner image T comes into contact with the heated surface of the fuser roller 61. At the fixing nip, the fuser roller 61 melts the toner particles with heat, while the pressure member 66 promotes settling of the molten toner by pressing the sheet S between the fixing belt 65 and the fuser roller 61. The toner image T thus processed under heat and pressure then cools and solidifies and becomes fixed in place as the sheet S leaves the fixing nip N to advance along the sheet feed path.

Figure 10:
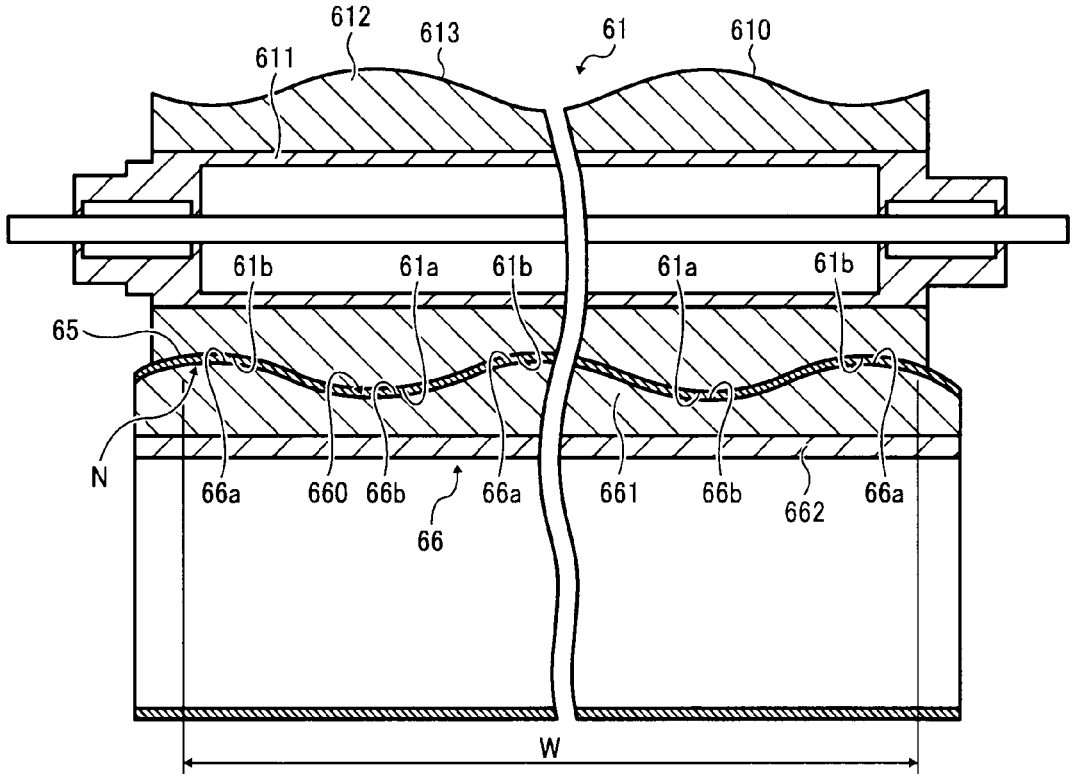
FIG. 10 shows a fuser roller and a pressure member mounted in the fixing device of FIG. 9.

FIG. 10 shows the fuser roller 61, the fixing belt 65, and the pressure member 66 installed in the fixing device 27, with the biasing mechanism of the pressure member 66 omitted for clarity.

As shown in FIG. 10, the configuration of the fuser roller 61 is similar to that depicted in FIG. 5 with its undulating surface 610 having the alternating series of at least one convex portion 61*a* and at least one concave portion 61*b* formed by varying the thickness of the elastic layer 612 along the longitudinal axis.

The pressure member 66 has an alternating series of at least one convex portion 66*a* curving outward and at least one concave portion 66*b* curving inward with respect to the longitudinal axis to define an undulating outer peripheral surface 660. The convex and concave portions 66*a* and 66*b* are formed by varying the thickness of the elastic layer 661, with the substrate 662 having a substantially uniform thickness or cross-section along the longitudinal axis.

Each of the convex and concave portions 66*a* and 66*b* has a height with respect to a circumferential plane of the fixing member 66 in a range of, for example, approximately 0.1 mm to approximately 0.5 mm, and a width along the longitudinal axis of the fixing member 66 of, for example, approximately 10 mm. The number of convex portions 66*a* and concave portions 66*b* each may be any number equal to or greater than one.

In the present embodiment, the convex portion 66*a* and the concave portion 66*b* are contiguous to each other so that the outer surface 660 as a whole has a continuously undulating configuration, such as a sinusoidal curve or other suitable curve, similar to those depicted in the embodiments described above. As in the case for the fuser roller 61, the series of convex and concave portions 66*a* and 66*b* of the pressure member 66 may span all or part of the maximum compatible sheet width W.

In the fixing device 27, the fuser roller 61 has the same number of convex portions 61*a* as the number of concave portions 66*b* of the pressure member 66, and the pressure member 66 has the same number of convex portions 66*a* as the number of concave portions 61*b* of the fuser roller 61. The convex portions 61*a* of the fuser roller 61 are similar in dimension and position, and preferably, complementary in shape, to the concave portions 66*b* of the pressure member 66 in the axial direction, and the convex portions 66*a* of the pressure member 66 are similar in dimension and position, and preferably, complementary in shape, to the concave portions 61*b* of the fuser roller 61 in the axial direction.

When properly mounted, the fuser roller 61 and the pressure member 66 have their cylindrical metal cores 611 and the substrate 662 uniformly spaced apart from each other and their undulating surfaces 610 and 660 engaged in pressure contact with each other through the fixing belt 65 along the fixing nip N, with each convex portion 61*a* of the fuser roller 61 fitting in the corresponding concave portion 66*b* of the pressure member 66, and each convex portion 66*a* of the pressure member 66 fitting in the corresponding concave portion 61*b* of the fuser roller 61. The fixing belt 65 bends and conforms to the undulating surfaces 610 and 660 when sandwiched between the fuser roller 61 and the pressure member 66, and recovers its original smooth shape when released from the fixing nip.

In such a configuration, the fixing device 27 according to this patent specification can temporarily stiffen a recording sheet S during passage through the fixing nip N, so as to reliably feed the sheet S without wrapping the sheet S around the fuser roller 61 even when the sheet S in use is relatively thin and consequently ready to bend and deviate from the proper feed path.

Specifically, with additional reference to FIG. 9, passing a recording sheet S through the fixing nip N causes the sheet S to conform to the undulating surfaces 610 and 660 of the fuser roller 61 and the pressure member 66. As the sheet S thus becomes undulated and corrugated, it temporarily exhibits an apparent stiffness greater than that exhibited without corrugation. Such temporary stiffing effect allows the recording sheet S to advance past the fixing nip N without wrapping around the fuser roller 61 and causing a jam at the fixing nip N, even when the sheet S in use is relatively thin and ready to bend due to adhesion of molten toner to the surface of the fuser roller 61.

Moreover, the fixing device 27 according to this patent specification can maintain a uniform pressure distribution throughout the fixing nip N to provide fixing with uniform gloss across a resulting image.

Specifically, the fuser roller 61 and the pressure member 66 contact each other at substantially uniform pressure along the fixing nip N owing to the engagement between the undulating surfaces 610 and 660 provided by fitting the corresponding convex and concave portions. Since gloss of an image printed on a recording medium depends on the pressure applied to the recording medium during fixing process, the uniform nip pressure exerted on the recording sheet S during passage through the fixing nip N provides uniform gloss across the image T.

Although not depicted in FIG. 10, the fixing members 61 and 66 are mounted in the fixing device 27 with a mounting mechanism similar to that depicted in FIG. 5, wherein the fixing members 61 and 66 have one pair of adjacent longitudinal ends positioned in alignment with each other, and the other pair of adjacent longitudinal ends displaceable along the respective longitudinal axes.

Thus, when the fixing members 61 and 66 expand along their respective longitudinal axes by being heated to the processing temperature during operation, they elongate solely on one side while maintaining their ends on the other side aligned with each other. This reduces the risk of misaligning corresponding concave and convex portions of the fixing members 61 and 66 after installation of the fixing device 27, which would otherwise detract from uniform nip pressure and from uniform gloss of a resulting image processed by the fixing device.

Preferably, the convex portion 61*a* of the fuser roller 61 and the concave portion 66*b* of the pressure member 66 have complementary shapes, and the convex portion 66*a* of the pressure member 66 and the concave portion 61*b* of the fuser roller 61 have complementary shapes, so that the fuser and pressure members 61 and 66 establish close contact with each other with no space between the undulating surfaces 610 and 660 at least over the maximum compatible sheet width W under no-load conditions.

For example, where one of the undulating surfaces 610 and 660 defines a sinusoidal curve of a given amplitude and frequency, it is desirable that the other one of the surfaces 610 and 660 defines a sinusoidal curve of the same amplitude and frequency to provide uniform close contact therebetween under no load condition. In this case, when plotted against the position along the longitudinal axes, the thicknesses of the elastic layers 612 and 662 trace a pair of sinusoidal waveforms opposite in phase and identical in amplitude and frequency with respect to each other.

Further, preferably, the total thickness of the elastic layers 612 and 661 present between the fixing members 61 and 66 is constant at every point along the fixing nip N when they contact each other under no-load conditions.

Still further, preferably, the convex and concave portions of the undulating fixing members 61 and 66 are contiguous to each other as in the embodiment depicted in FIG. 10.

Still further, preferably, the amplitude H of the undulating surfaces 610 and 660 are in a range of approximately 0.16 mm to approximately 0.8 mm under load condition.

Where the elastic layers 612 and 661 are compressed at a compression ratio of approximately 20%, the amplitude H of the undulating surfaces 610 and 660 may be in a range of approximately 0.16 mm to approximately 0.8 mm under load condition, and in a range of approximately 0.2 mm to approximately 1 mm under no-load conditions.

Experiments described below are conducted to evaluate the efficacy of the fixing device 27 in terms of sheet feeding performance and uniformity in nip pressure, and specifically, those of the undulating fixing members according to this patent specification in comparison with conventional configurations of fixing members.

Experiment 1

Sheet feeding effect of the undulating fixing roller was evaluated using fixing devices T1 through T3: test device T1 incorporating a pair of undulating rollers each having three convex and three concave portions to form undulations with an amplitude of approximately 0.2 mm under no-load conditions; test device T2 incorporating a pair of undulating rollers each having seven convex and seven concave portions to form undulations with an amplitude of approximately 0.2 mm under no-load conditions; and test device T3 having a pair of simple cylindrical rollers each with no undulation on the outer surface for comparison purposes. Each of the rollers has an elastic layer having a thickness of 1.7 mm.

Figure 11:
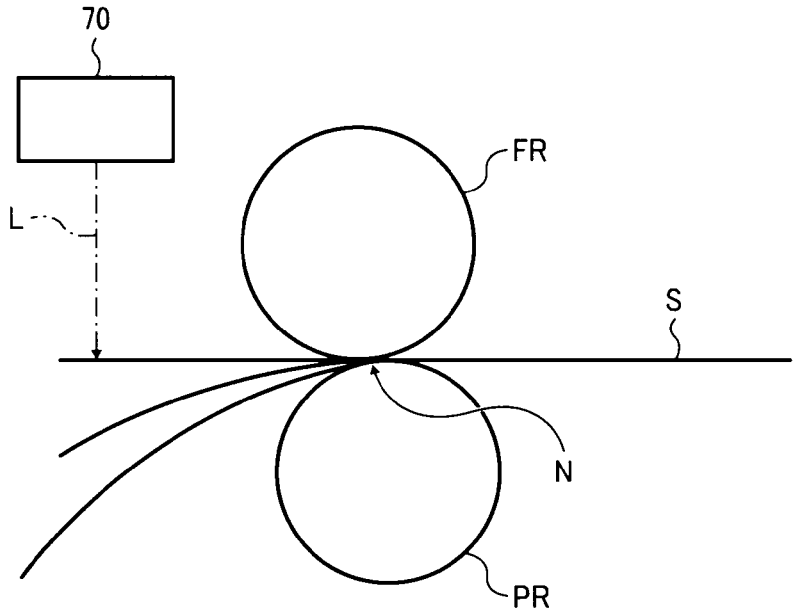
FIG. 11 shows test equipment used in experiments for evaluating sheet stiffing effect of the fixing device according to this patent specification.

Apparent stiffness exhibited by paper sheets during passage through the fixing nip was measured with equipment as shown in FIG. 11. As shown, the measurement equipment includes a laser displacement sensor 70 that directs a laser beam L toward a measurement point downstream of a fixing nip N defined between a fuser roller FR and a pressure roller PR to obtain an amount by which a paper sheet S displaces from a reference plane representing the proper sheet feed path as it passes the measurement point.

In measurement, the paper sheet S was fed into the fixing nip N along the sheet feed path. As the leading edge of the sheet S reached the measurement point, the rollers FR and PR stopped rotation to hold the sheet S at the fixing nip N, and the displacement sensor 70 measured the displacement of the sheet S from the proper sheet feed path. Then the rollers FR and PR resumed rotation to advance the sheet S by a given distance, and the displacement sensor 70 again measured the displacement of the sheet S from the proper sheet feed path.

After measurement, apparent stiffness of the paper sheet S during passage through the fixing nip N was determined based on an amount by which the sheet S was bent away from the sheet feed path as it passes through the fixing nip N, calculated as a difference between the displacements measured at different positions of the sheet S passing through the fixing nip N. The experiments were conducted on each test device using three types of paper sheets: thin paper S1 weighing 64 grams per square meter ($g/m^2$), thick paper S2 weighing 69 $g/m^2$, and very thick paper S3 weighing 90 $g/m^2$.

Figure 12:
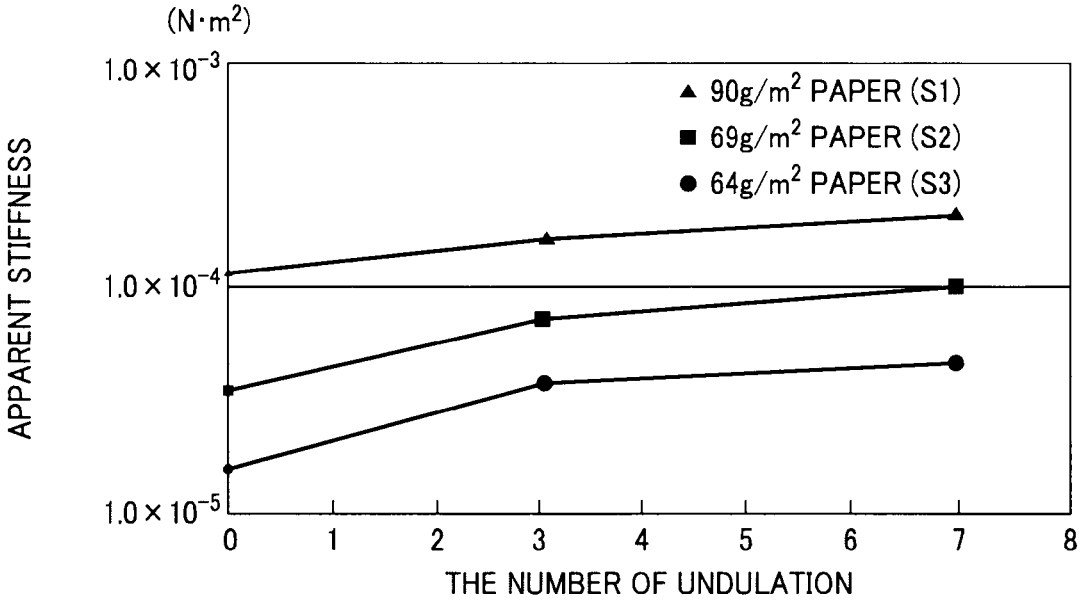
FIG. 12 is a graph plotting measurements of apparent stiffness of paper sheets obtained through the experiments.

FIG. 12 is a graph plotting measurements of apparent stiffness of the paper sheets S1 through S3 in $N*m^2$ against number of undulations per roller of the fixing device. In this graph, the undulation number of 3 indicates measurements obtained using the test device T1, of 7 indicates those obtained using the test device T2, and of 0 indicates those obtained using the comparative test device T3.

As shown in FIG. 12, all the three types of paper sheets S1 through S3 exhibited greater values of apparent stiffness with the test devices T1 and T2 than with the device T3. Moreover, the apparent stiffness of each type of paper S obtained with the device T2 with seven undulations is greater than that obtained with the device T1 with three undulations.

The experimental results shows that passing a paper recording sheet through a nip defined between a pair of undulating rollers increases the apparent stiffness of the sheet compared to that exhibited by the sheet passed through a nip defined between a pair of perfectly cylindrical rollers, which demonstrates the sheet stiffening effect provided by the fixing device 27 according to this patent specification. Also, comparison of the test devices T1 and T2 with different numbers of roller undulations indicates that the stiffening effect of the undulating roller increases with the number of undulations.

Experiment 2

Sheet stiffening effect of an undulating roller pair was evaluated using fixing devices T4 and T5: test device T4 with a pair of rollers each having only a single convex or concave portion forming a simple outward or inward curve on the roller surface; and test device T5 with a pair of rollers each having a single convex portion and a single concave portion together forming one undulation on the roller surface.

In Experiment 2, apparent stiffness of a recording sheet during passage through the fixing nip N was measured using multiple sets of test devices with varying amplitudes of curve or undulation for each of the fixing devices T4 and T5.

Figure 13A:
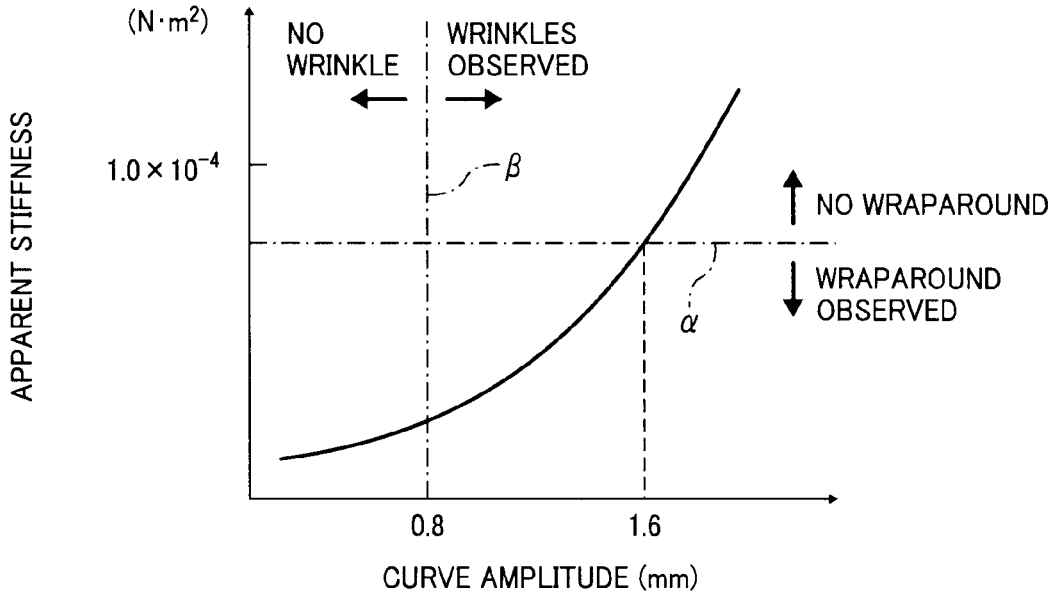
FIGS. 13A and 13B are graphs plotting measurements of apparent sheet stiffness against amplitude of curve or undulation of test devices obtained through the experiment.
Figure 13B:
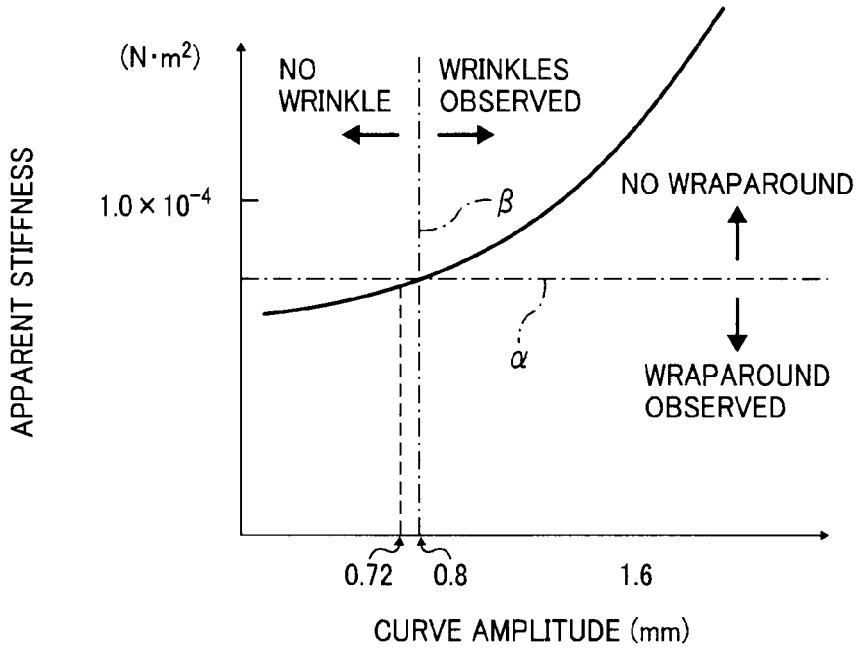

FIGS. 13A and 13B are graphs plotting measurements of apparent sheet stiffness in $N*m^2$ against the amplitude of curve or undulation in mm of the test device T4 and T5, respectively, obtained through Experiment 2. In the graphs, a line α represents a minimum allowable sheet stiffness with which the fixing device can feed a recording sheet through the fixing nip without wrapping around the fuser roller, and a line β represents a maximum allowable amplitude of curve or undulation with which the fixing device can forward a recording sheet without causing wrinkles on the sheet.

As shown in FIGS. 13A and 13B, an increase in apparent sheet stiffness was effected by increasing the amount of curve or undulation amplitude in each of the test devices T4 and T5, and the sheet stiffening effect at a given curve/undulation amplitude observed in the device T5 was significantly greater than that observed in the device T4.

Specifically, as shown in FIG. 13A, the apparent stiffness of the recording sheet obtained using the device T4 reaches the minimum allowable stiffness a at a curve amplitude of approximately 1.6 mm which is beyond the maximum allowable amplitude β of 0.8 mm. This means that the recording sheet can pass through the fixing nip N without wraparound but with wrinkles when the curve amplitude is over 1.6 mm, and without wrinkles but with wraparound when the curve amplitude is below 0.8 mm.

On the other hand, as shown in FIG. 13B, the apparent stiffness of the recording sheet obtained using the device T5 reaches the minimum allowable stiffness α at an undulation amplitude of approximately 0.72 mm which is below the maximum allowable amplitude β of 0.8 mm. This means that the recording sheet can pass through the fixing nip N without wrinkles and/or wraparound where the amplitude of undulation is in the range of 0.72 mm to 0.8 mm.

The experimental results show that the pair of undulating rollers is superior to the pair of simply curved rollers in terms of sheet stiffening effect obtained with a given value of curve/undulation amplitude, in which feeding the recording sheet without wraparound and wrinkles is possible with the pair of undulating rollers with adequate undulation amplitude, but not with the pair of simply curved rollers. This demonstrates the superiority of the fixing device according to this patent specification having a pair of undulating rollers each with at least one undulation, of which the sheet stiffening effect may be further enhanced by increasing the number of undulations as indicated by the results of Experiment 1.

Although the experiments described above were conducted on a fixing device with a pair of undulating fixing rollers, the results of these experiments give evidence of and explain the efficacy of other configurations of the fixing device according to this patent specification, such as those with fixing members with partially straight convex and concave portions, and those using a stationary pressure member with a fixing belt in place of a pressure roller, since fundamental mechanism that provides the sheet stiffening effect and the uniform nip pressure is common to all the embodiments of the fixing device depicted in this patent specification.

Next, exemplary embodiments of the toner according to this patent specification are described in detail.

It takes only a short time of several tens to several hundreds milliseconds for toner to pass through the fixing nip in the above-described fixing device during fixing operation. Therefore, the toner is unlikely to be heated to above the surface temperature of the fuser roller. The surface temperature of the fuser roller generally varies by location from about 100 to 150° C. In a case where the toner drastically changes its loss elastic modulus at 100 to 150° C., generation of undesired stripe-patterned gloss difference in the paper feed direction may be accelerated. By contrast, when the toner changes its loss elastic modulus only slightly at 100 to 150° C., generation of undesired stripe-patterned gloss difference in the paper feed direction may be suppressed. In particular, when the ratio (G"(100)/G"(150)) of the loss elastic modulus at 100° C. (G"(100)) to the loss elastic modulus at 150° C. (G"(150)) of the toner is from 1 to 20, preferably from 1 to 18, and more preferably from 1 to 16, generation of undesired stripe-patterned gloss difference in the paper feed direction is suppressed.

To reliably fix a toner on a recording sheet, the loss elastic modulus at 100° C. (G"(100)) of the toner is preferably 80,000 Pa·s or less, more preferably 75,000 Pa·s or less, and most preferably 70,000 Pa·s or less. When G"(100) is too large, toner particles may insufficiently deform (melt) when fixed on a recording sheet, resulting in a low-gloss and low-quality image. Insufficient deforming (melting) of toner particles causes insufficient immersion of the toner particles in a recoding sheet as well as insufficient fusing of the toner particles. Such insufficiently-deformed toner particles easily release from the recording sheet when the recording sheet is scraped with another sheet or a sharp writing material such as a mechanical pencil.

On the other hand, in a case where toner particles are sufficiently immersed in a recording sheet, it is likely that background portions as well as paper fibers of the recording sheet are exposed, which results in poor image density and density evenness. In view of this, the loss elastic modulus at 150° C. (G"(150)) of the toner is preferably 2,000 Pa·s or more, more preferably 3,000 Pa·s or more, and most preferably 4,000 Pa·s or more.

Such a toner expressing a substantially-constant predetermined loss elastic modulus within a wide temperature range is obtainable by including a binder resin including cross-linked components wherein the distance between cross-linking points is relatively long.

Toner particles are generally produced from granulation methods called dissolution suspension methods, suspension polymerization methods, and emulsion aggregation methods, for example, the details thereof being described later. Preferably, cross-linked components are formed at the time of formation of toner particles by the above methods. For example, when toner particles are formed by a dissolution suspension method, it is preferable that a resin having a branched molecular structure is elongated in a suspension. As another example, when toner particles are formed by a suspension polymerization method or an emulsion aggregation method, it is preferable that a multifunctional monomer or macro monomer is polymerized to form a cross-linking structure wherein the distance between cross-linking points is relatively long. Moreover, when toner particles are formed by an emulsion aggregation method, it is preferable that aggregation is accelerated by a polyvalent ion to form a metal-bridged structure.

First, dissolution suspension methods are described in detail. A dissolution suspension method generally includes the steps of: dissolving or dispersing toner components including a resin and a colorant in an organic solvent; dispersing the resultant solution or dispersion in an aqueous medium containing a dispersing agent with a stirrer, a homomixer, or a homogenizer, to obtain toner particle droplets with a desired size distribution; removing the organic solvent therefrom to obtain a toner slurry; and washing, filtering, and drying the toner slurry to separate toner particles.

Specific examples of usable resins for the dissolution suspension methods include, but are not limited to, polyester resins, styrene-acrylic resins, polyol resins, vinyl resins, polyurethane resins, epoxy resins, polyamide resins, polyimide resins, silicone resins, phenol resins, melamine resins, urea resins, aniline resins, ionomer resins, and polycarbonate resins, all of which are soluble in solvents. From the viewpoint of fixability of the resultant toner, polyester resins are most preferable.

It is also preferable that an isocyanate-modified polyester resin, the terminal ends of which have an isocyanate group, are subjected to elongation at the time of formation of toner particles to form a cross-linking structure in the resultant toner particles.

The isocyanate-modified polyester resin may be formed by, for example, reacting a polyester having an active hydrogen group, which is a polycondensation products of a polyol (1) with a polycarboxylic acid (2), with a polyisocyanate (3). The active hydrogen group may be, for example, a hydroxyl group (e.g., an alcoholic hydrogen group, a phenolic hydrogen group), an amino group, a carboxyl group, or a mercapto group, and is most preferably an alcoholic hydrogen group.

The polyol (1) may be a diol (1-1), a polyol (1-2) having 3 or more valences, or a mixture thereof. Preferably, the polyol (1) is a diol (1-1) alone or a mixture of a diol (1-1) with a small amount of a polyol (1-2).

Specific examples of the diol (1-1) include, but are not limited to, alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); alkylene oxide (e.g., ethylene oxide, propylene oxide, butylene oxide) adducts of the above-described alicyclic diols; and alkylene oxide (e.g., ethylene oxide, propylene oxide, butylene oxide) adducts of the above-described bisphenols.

Among these materials, alkylene glycols having 2 to 12 carbon atoms and alkylene oxide adducts of bisphenols are preferable, and alkylene oxide adducts of bisphenols and mixture of an alkylene oxide adduct of a bisphenol with an alkylene glycol having 2 to 12 carbon atoms are more preferable.

Specific examples of the polyol (1-2) having 3 or more valences include, but are not limited to, polyvalent aliphatic alcohols having 3 or more valences (e.g., glycerin, trimethylolethane, trimethylolpropane, pentaerythritol, sorbitol); polyphenols having 3 or more valences (e.g., trisphenol PA, phenol novolac, cresol novolac); and alkylene oxide adducts of the above-described polyphenols having 3 or more valences.

The polycarboxylic acid (2) may be a dicarboxylic acid (2-1), a polycarboxylic acid (2-2) having 3 or more valences, or a mixture thereof. Preferably, polycarboxylic acid (2) is a dicarboxylic acid (2-1) alone or a mixture of a dicarboxylic acid (2-1) with a small amount of a polycarboxylic acid (2-2).

Specific examples of the dicarboxylic acid (2-1) include, but are not limited to, alkylene dicarboxylic acids (e.g., succinic acid, adipic acid, sebacic acid); alkenylene dicarboxylic acids (e.g., maleic acid, fumaric acid); and aromatic dicarboxylic acids (e.g., phthalic acid, isophthalic acid, terephthalic acid, naphthalenedicarboxylic acid). Among these materials, alkenylene dicarboxylic acids having 4 to 20 carbon atoms and aromatic dicarboxylic acids having 8 to 20 carbon atoms are preferable.

Specific examples of the polycarboxylic acid (2-2) having 3 or more valences include, but are not limited to, aromatic polycarboxylic acids having 9 to 20 carbon atoms (e.g., trimellitic acid, pyromellitic acid).

The polycarboxylic acid (2) may also be an acid anhydride or a lower alkyl ester (e.g., methyl ester, ethyl ester, isopropyl ester) of the above-described dicarboxylic acids (2-1) and polycarboxylic acids (2-2).

The equivalent ratio ([OH]/[COOH]) of hydroxyl groups [OH] in the polyol (1) to carboxyl groups [COOH] in the polycarboxylic acid (2) is from 2/1 to 1/1, preferably from 1.5/1 to 1/1, and more preferably from 1.3/1 to 1.02/1.

Specific examples of the polyisocyanate (3) include, but are not limited to, aliphatic polyisocyanates (e.g., tetramethylene diisocyanate, hexamethylene diisocyanate, 2,6-diisocyanatomethyl caproate); alicyclic polyisocyanates (e.g., isophorone diisocyanate, cyclohexylmethane diisocyanate); aromatic diisocyanates (e.g., tolylene diisocyanate, diphenylmethane diisocyanate); aromatic aliphatic diisocyanates (e.g., $\alpha,\alpha,\alpha',\alpha'$-tetramethylxylylene diisocyanate); isocyanurates; the above-described polyisocyanates blocked with a phenol derivative, an oxime, or a caprolactam; and mixtures thereof.

The equivalent ratio ([NCO]/[OH]) of isocyanate groups [NCO] in the polyisocyanate (3) to hydroxyl groups [OH] in the polyester is from 5/1 to 1/1, preferably from 4/1 to 1.2/1, and more preferably from 2.5/1 to 1.5/1. When the equivalent ratio ([NCO]/[OH]) is too large, residual polyisocyanate may degrade chargeability of the resultant toner.

An amine (B) may be used as an elongating agent for elongating the isocyanate-modified polyester.

The amine (B) may be a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmethane, tetrafluoro-p-xylylenediamine, tetrafluoro-p-phenylenediamine), alicyclic diamines (e.g., 4,4'-diamino-3,3'-dimethyldicyclohexylmethane, diamine cyclohexane, isophoronediamine), and aliphatic diamines (e.g., ethylenediamine, tetramethylenediamine, hexamethylenediamine, dodeca fluoro hexylenediamine, tetracosa fluoro dodecylenediamine).

Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline.

Specific examples of the amino mercaptan (B4) include, but are not limited to, aminoethyl mercaptan and aminopropyl mercaptan.

Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

Among these amines (B), a diamine (B1) alone and a mixture of a diamine (B1) with a small amount of a polyamine (B2) having 3 or more valences are preferable.

The equivalent ratio ([NCO]/[NHx]) of isocyanate groups [NCO] in the isocyanate-modified polyester to amino groups [NHx] in the amine (B) is from 1/2 to 2/1, preferably from 1.5/1 to 1/1.5, and more preferably from 1.2/1 to 1/1.2. When the equivalent ratio ([NCO]/[NHx]) is too large or small, the isocyanate-modified polyester may not be sufficiently elongated and desired viscoelasticity may not be exhibited.

For the purpose of controlling viscoelasticity of the resulting toner, using at least one straight-chain isocyanate-modified polyester in combination with at least one branched-chain isocyanate-modified polyester is more preferable than using only one isocyanate-modified polyester. In order that the resulting toner may evenly include a cross-linking structure, in which the distance between cross-linking points is relatively long, throughout the toner, using a branched-chain isocyanate-modified polyester having a relatively low molecular weight in combination with a straight-chain isocyanate-modified polyester is preferable. An isocyanate-modified polyester simply having a long molecular chain may degrade thermal properties of the resulting toner. Such a long molecular chain is likely to contract to form a random coil structure, forming a local cross-linking structure or bringing the isocyanate groups to intermolecular reaction. Consequently, the resulting toner may not evenly include cross-linking structures throughout the toner.

Additionally, for the purpose of controlling viscoelasticity of the resulting toner, an unmodified polyester may also be used in combination with the isocyanate-modified polyester. The unmodified polyester may be a polycondensation product of the above-described polyol (1) with the above-described polycarboxylic acid (2), for example.

Organic solvents usable for the dissolution suspension methods preferably have a boiling point less than 100° C. so as to be easily removable. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination.

The aqueous medium may be water or a combination of water and a water-miscible solvent. Specific examples of the water-miscible solvent include, but are not limited to, alcohols (e.g., methanol, isopropanol, ethylene glycol), cellosolves (e.g., dimethylformamide, tetrahydrofuran, methyl cellosolve), and lower ketones (e.g., acetone, methyl ethyl ketone). A suitable amount of the aqueous medium is preferably from 50 to 2,000 parts by weight, and more preferably from 100 to 1,000 parts by weight, based on 100 parts by weight of toner components. When the amount of the aqueous medium is too small, toner components may be insufficiently dispersed in the resultant toner. When the amount of the aqueous medium is too large, the toner manufacturing cost may increase.

Specific examples of usable dispersing agents include, but are not limited to, inorganic materials such as tricalcium phosphate, magnesium phosphate, aluminum phosphate, zinc phosphate, magnesium carbonate, calcium hydroxide, magnesium hydroxide, aluminum hydroxide, calcium metasilicate, calcium sulfate, barium sulfate, bentonite, alumina, calcium carbonate, titanium oxide, colloidal silica, and hydroxyapatite.

Next, emulsion aggregation methods are described in detail. An emulsion aggregation method generally includes the steps of: mixing respective aqueous dispersions of resin particles, colorant particles, and wax particles to aggregate and fuse each particle to obtain toner particles; and washing, filtering, and drying the resulting toner slurry to separate the toner particles.

The resin particle may be a polyester resin, a styrene-acrylic resin, or a polyol resin, for example. Among these resins, styrene-acrylic resins are preferable for the resin particles because a dispersion is easily obtained by an emulsion polymerization that is easily controllable. In particular, a dispersion of a styrene-acrylic resin can be obtained by emulsifying a monomer in an aqueous medium with an emulsifier and subjecting the monomer to an emulsion polymerization with a polymerization initiator.

Specific examples of usable monomers for the emulsion polymerization include, but are not limited to, vinyl monomers including styrenes (e.g., styrene, p-methylstyrene, p-styrene sulfonic acid, p-chlorostyrene, p-carboxystyrene, α-methylstyrene) and derivatives thereof; vinyl esters (e.g., vinyl naphthalene, vinyl chloride, vinyl bromide, vinyl fluoride, vinyl acetate, vinyl propionate, vinyl benzoate, vinyl butyrate); acrylic acids and acrylates (e.g., methyl acrylate, ethyl acrylate, propyl acrylate, isopropyl acrylate, butyl acrylate, t-butyl acrylate, hexyl acrylate, octyl acrylate, 2-ethylhexyl acrylate, decyl acrylate, dodecyl acrylate, stearyl acrylate, behenyl acrylate); methacrylic acids and methacrylates (e.g., methyl methacrylate, ethyl methacrylate, propyl methacrylate, isopropyl methacrylate, butyl methacrylate, t-butyl methacrylate, hexyl methacrylate, octyl methacrylate, 2-ethylhexyl methacrylate, decyl methacrylate, dodecyl methacrylate, stearyl methacrylate, behenyl methacrylate); acrylamides (e.g., N,N-dimethylacrylamide, N,N-diethylacrylamide, N,N-dibutylacrylamide); and maleic acid, maleic anhydride, maleic acid monoester, maleic acid diester, and itaconic acid and esters thereof. Among these monomers, those soluble in water are preferable in consideration of the reaction mechanism.

In order to form an ionic cross-linking site with a metal cation in the subsequent aggregating process, a monomer having an anionic functional group is preferably used. Specific examples of such monomers include, but are not limited to, acrylic acid, methacrylic acid, malic anhydride, maleic acid monoester, itaconic acid, itaconic acid mono ester, and p-styrene sulfonic acid.

In order to form a cross-linking structure in the resulting resin particle, multifunctional monomers (e.g., divinylbenzene, 1,6-hexanediol diacrylate, 1,10-decanediol diacrylate) are preferable used in combination with the above-described monomers. Among these monomer, 1,6-hexanediol diacrylate and 1,10-decanediol diacrylate are preferable because they provide a relatively long distance between cross-linking points.

Specific examples of usable emulsifiers include, but are not limited to, anionic emulsifiers (e.g., sodium alkyl sulfate, sodium alkylbenzene sulfonate, polyoxyethylene alkyl ether sodium sulfate, sodium alkyl naphthalene sulfonate, sodium dialkyl sulfosuccinate, alkyl diphenyl ether sodium disulfonate); nonionic emulsifiers (e.g., polyoxyethylene alkyl ether, polyoxyethylene alkenyl ether, polyoxypropyl alkyl ether, fatty acids ester of sorbitan); cationic emulsifiers (e.g., alkyl trimethyl ammonium chloride, dialkyl dimethyl ammonium chloride); and amphoteric emulsifiers (e.g., alkyl betain). Among these emulsifiers, anionic emulsifiers are preferable because of having good emulsification stability. Reactive emulsifiers having both a hydrophilic group and a polymerizable functional group are also preferable because they are capable of stabilizing the resulting dispersion.

Specific examples of usable polymerization initiators include, but are not limited to, water-soluble initiators (e.g., ammonium persulfate, potassium persulfate, sodium persulfate, hydrogen peroxide, 4,4'-azobis(4-cyanovaleric acid) and salts thereof, 2,2'-azobis(2-amidinopropane) salts); azo or diazo initiators (e.g., 2,2'-azobis(2,4-dimethylvaleronitrile), 2,2'-azobis(isobutyronitrile), 1,1'-azobis(cyclohexane-1-carbonitrile), 2,2'-azobis(4-methoxy-2,4-dimethylvaleronitrile), azobis(isobutyronitrile)); and oil-soluble initiators (e.g., benzoyl peroxide, methyl ethyl ketone peroxide, diisopropyl peroxycarbonate, cumene hydroperoxide, 2,4-dichlorobenzoyl peroxide, lauroyl peroxide). Among these initiators, water-soluble initiators and a combination of a water-soluble initiator and an oil-soluble initiator are preferable.

At the time of mixing of respective dispersions of resin particles, colorant particles, and wax particles, the particles are aggregated with a metal salt serving as an aggregating agent. The metal cations in the metal salt form salts with plural anionic functional groups in the resin particles. In a case where the metal cations are polyvalent, the metal cations form cross-linking points as well as salts with plural anionic functional groups in the resin particles, controlling viscoelasticity of the resulting toner. Specific examples of usable polyvalent metal salts include, but are not limited to, divalent metal salts (e.g., calcium chloride, zinc chloride, copper sulfate, magnesium sulfate, manganese sulfate); and trivalent metal salts (e.g., aluminum hydroxide, aluminum chloride, iron chloride). Among these, trivalent metal salts are preferable.

In a case where a large number of metallic cross-linking points are introduced, the toughness of the resulting toner may increase too much, causing insufficient melting and weak anchoring in paper. To solve this problem, a resin which is unlikely to form metallic cross-linking structure is used in combination. Such a resin can sufficiently melt and strongly anchor in paper, improving fixability of the toner. Specific examples of resins which are unlikely to form metallic cross-linking structure include, but are not limited to, resins having no or a small amount of anionic functional group. The anionic functional group may be a carboxyl group derived from acrylic acid, methacrylic acid, maleic acid, or itaconic acid; or a sulfonyl group derived from monomers such as p-styrene sulfonate and 2-acrylamide-2-methylpropane sulfonate and initiators such as potassium persulfate and ammonium persulfate. Accordingly, resins which are unlikely to form metallic cross-linking structure can be obtained by using no or a little amount of such monomers or initiators.

Next, suspension polymerization methods are described in detail. A suspension polymerization method generally includes the steps of: uniformly dissolving or dispersing toner components including a colorant in a monomer along with a polymerization initiator, using a homogenizer or an ultrasonic disperser; dispersing the resultant solution or dispersion in an aqueous medium containing a dispersion stabilizer with a stirrer, a homomixer, or a homogenizer, to form monomer droplets; and subjecting the monomer to a polymerization to form toner particles.

At the time of dispersing the monomer solution or dispersion in the aqueous medium, the revolution speed and dispersing time are controlled so that the monomer droplets have a desired particle diameter of the resultant toner. After adjusting the particle diameter of the monomer droplets, the monomer droplets are maintained in a particle state owing to the presence of the dispersion stabilizer, while being agitated so as not to settle down.

The polymerization generally undergoes at 40° C. or more, and preferably at 50 to 90° C. The reaction system may only be heated at the latter part of the polymerization. The aqueous medium may be removed at the latter part or after the termination of the polymerization so that unreacted monomers and by-products, which emit odor when the toner is fixed on recording media, are removed. After the termination of the polymerization, the resultant toner particles are subjected to washing, filtering, and drying.

Specific monomers usable for the suspension polymerization methods include the above-described monomers usable for the emulsion polymerizations. Additionally, monomers with low water-solubility or insolubility are also usable because monomers do not need to migrate through an aqueous medium in the suspension polymerization methods. Moreover, macro monomers that have a large molecular weight are also usable.

The above-described polyfunctional monomers usable for the emulsion polymerizations are also usable for the purpose of forming cross-linking structure. For example, a polyester having terminal acryloyl or methacryloyl groups is a suitable example for the polyfunctional monomer. Such a polyester is prepared by reacting a polyester having terminal hydroxyl groups with a vinyl monomer having a carboxylic acid (e.g., acrylic acid, methacrylic acid).

Specific examples of the dispersion stabilizer include, but are not limited to, inorganic compounds such as tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina; and organic compounds such as polyvinyl alcohol, gelatin, methyl cellulose, methyl hydroxypropyl cellulose, ethyl cellulose, sodium salt of carboxymethyl cellulose, polyacrylic acid and salts thereof, and starch. The amount of the dispersion stabilizer in an aqueous medium is preferably from 0.2 to 20% by weight based on the monomers.

Compared to commercially-available tricalcium phosphate, much finer particles thereof can be obtained by mixing a water solution of sodium phosphate and a water solution of calcium chloride at a high revolution speed.

Specific polymerization initiators usable for the suspension polymerization methods include the above-described polymerization initiators usable for the emulsion polymerizations. In particular, oil-soluble polymerization initiators and a combination of an oil-soluble polymerization initiator with a water-soluble polymerization initiator are preferable.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Synthesis of Isocyanate-Modified Polyester 1)

A reaction vessel equipped with a condenser, a stirrer, and a nitrogen inlet pipe is charged with 682 parts of ethylene oxide 2-mol adduct of bisphenol A, 81 parts of propylene oxide 2-mol adduct of bisphenol A, 283 parts of terephthalic acid, 22 parts of trimellitic anhydride, and 2 parts of dibutyl tin oxide. The mixture is subjected to a reaction for 8 hours at 230° C. under normal pressure. The mixture is further subjected to a reaction for 5 hours under reduced pressures of from 1.3 to 2.0 kPa (from 10 to 15 mmHg). Thus, an intermediate polyester 1 is prepared.

The intermediate polyester 1 has a number average molecular weight of 2,200, a weight average molecular weight of 9,700, a glass transition temperature of 54° C., an acid value of 0.5 mgKOH/g, and a hydroxyl value of 52 mgKOH/g.

Another reaction vessel equipped with a condenser, a stirrer, and a nitrogen inlet pipe is charged with 410 parts of the intermediate polyester 1, 89 parts of isophorone diisocyanate, and 500 parts of ethyl acetate. The mixture is subjected to a reaction for 5 hours at 100° C. Thus, an isocyanate-modified polyester 1 is prepared.

(Synthesis of Isocyanate-Modified Polyester 2)

A reaction vessel equipped with a condenser, a stirrer, and a nitrogen inlet pipe is charged with 660 parts of ethylene oxide 2-mol adduct of bisphenol A, 72 parts of propylene oxide 2-mol adduct of bisphenol A, 290 parts of terephthalic acid, 33 parts of trimellitic anhydride, and 2 parts of dibutyl tin oxide. The mixture is subjected to a reaction for 9 hours at 230° C. under normal pressure. The mixture is further subjected to a reaction for 7 hours under reduced pressures of from 1.3 to 2.0 kPa (from 10 to 15 mmHg). Thus, an intermediate polyester 2 is prepared.

The intermediate polyester 2 has a number average molecular weight of 3,800, a weight average molecular weight of 15,000, an acid value of 0.5 mgKOH/g, and a hydroxyl value of 51 mgKOH/g.

Another reaction vessel equipped with a condenser, a stirrer, and a nitrogen inlet pipe is charged with 410 parts of the intermediate polyester 2, 88 parts of isophorone diisocyanate, and 500 parts of ethyl acetate. The mixture is subjected to a reaction for 5 hours at 100° C. Thus, an isocyanate-modified polyester 2 is prepared.

(Synthesis of Unmodified Polyester 1)

A reaction vessel equipped with a condenser, a stirrer, and a nitrogen inlet pipe is charged with 241 parts of ethylene oxide 2-mol adduct of bisphenol A, 514 parts of propylene oxide 2-mol adduct of bisphenol A, 106 parts of terephthalic acid, 102 parts of isophthalic acid, 46 parts of adipic acid, and 2 parts of dibutyl tin oxide. The mixture is subjected to a reaction for 9 hours at 230° C. under normal pressure.

The mixture is further subjected to a reaction for 6 hours under reduced pressures of from 1.3 to 2.3 kPa (from 10 to 18 mmHg). Subsequently, 41 parts of trimellitic anhydride are added to the reaction vessel, and the mixture is further subjected to a reaction for 2 hours at 180° C. under normal pressure. Thus, an unmodified polyester 1 is prepared.

The unmodified polyester 1 has a number average molecular weight of 2,600, a weight average molecular weight of 7,100, and an acid value of 22 mgKOH/g.

(Preparation of Master Batch 1)

First, 40 parts of a cyan pigment (Pigment Blue 15:3), 60 parts of the unmodified polyester 1, and 30 parts of water are mixed with a HENSCHEL MIXER, to prepare a pigment mixture in which water is immersed in pigment aggregations. The pigment mixture is then kneaded for 45 minutes using a double-roll kneader with setting the roll surface temperature to 130° C. The kneaded pigment mixture is pulverized into particles with a diameter of 1 mm. Thus, a master batch 1 is prepared.

(Preparation of Pigment-Wax Dispersion 1)

A vessel equipped with a stirrer and a thermometer is charged with 504 parts of the unmodified polyester 1, 55 parts of a paraffin wax (having a melting point of 74° C.), and 920 parts of ethyl acetate. The mixture is heated to 80° C. while being agitated and kept at 80° C. for 5 hours, followed by cooling to 30° C. over a period of 1 hour. Subsequently, 326 parts of the master batch 1 and 100 parts of ethyl acetate are further added to the vessel and the mixture is agitated for 1 hour. Thus, a raw material liquid 1 is prepared.

Next, 1,800 parts of the raw material liquid 1 are contained in a vessel and subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Further, 1,200 parts of a 60% ethyl acetate solution of the unmodified polyester 1 and 90 parts of ethyl acetate are added to the vessel and the mixture is subjected to the above dispersion treatment again except for changing the repeat number of dispersion operation to 1 time. Thus, a pigment-wax dispersion 1 is prepared. An appropriate amount of ethyl acetate is added to the pigment-wax dispersion 1 so that the solid content becomes 50% by weight.

(Preparation of Aqueous Medium 1)

An aqueous medium 1 is prepared by mixing 970 parts of ion-exchange water, 40 parts of a 25% aqueous solution of an organic particulate resin (a copolymer of styrene, methacrylic acid, butyl acrylate, and sodium salt of sulfate ester of ethylene oxide adduct of methacrylic acid), 140 parts of a 48.5% aqueous solution of dodecyl diphenyl ether sodium disulfonate, and 90 parts of ethyl acetate.

(Emulsification)

First, 975 parts of the pigment-wax dispersion 1 and 7.5 parts of isophorone diamine are mixed with a TK HOMOMIXER (from PRIMIX Corporation) for 1 minute at a revolution of 5,000 rpm. Next, 231 parts of the isocyanate-modified polyester 1 and 58 parts of the isocyanate-modified polyester 2 are mixed therein with a TK HOMOMIXER (from PRIMIX Corporation) for 1 minute at a revolution of 5,000 rpm. Further, 1,200 parts of the aqueous medium 1 are mixed therein with a TK HOMOMIXER for 20 minutes at a revolution of from 8,000 to 13,000 rpm. Thus, an emulsion slurry 1 is prepared.

(Solvent Removal)

The emulsion slurry 1 is contained in a vessel equipped with a stirrer and a thermometer and subjected to solvent removal for 8 hours at 30° C. Thus, dispersion slurry 1 is prepared.

(Washing and Drying)

First, 100 parts of the dispersion slurry 1 is filtered under a reduced pressure to obtain a wet cake (i).

The wet cake (i) is mixed with 100 parts of ion-exchange water with a TK HOMOMIXER for 10 minutes at a revolution of 12,000 rpm, followed by filtering, to obtain a wet cake (ii).

The wet cake (ii) is mixed with 900 parts of ion-exchange water with a TK HOMOMIXER for 30 minutes at a revolution of 12,000 rpm while applying ultrasonic vibration thereto, followed by filtering under a reduced pressure. This operation is repeated until the re-slurry liquid has an electric conductivity of 10 μS/cm or less, to obtain a wet cake (iii).

The wet cake (iii) is mixed with a 10% aqueous solution of hydrochloric acid so that the re-slurry liquid has a pH of 4, followed by 30-minute mixing using a THREE-ONE MOTOR and filtering, to obtain a wet cake (iv).

The wet cake (iv) is mixed with 100 parts of ion-exchange water with a TK HOMOMIXER for 10 minutes at a revolution of 12,000 rpm, followed by filtering. This operation is repeated until the re-slurry liquid has an electric conductivity of 10 μS/cm or less, to obtain a wet cake (v).

The wet cake (v) is dried for 48 hours at 42° C. using a circulating air drier, followed by sieving with a screen having openings of 75 μm. Thus, a mother toner 1 is prepared.

Next, 100 parts of the mother toner 1 are mixed with 0.8 parts of a hydrophobized silica and 0.2 parts of a hydrophobized titanium oxide using a HENSCHEL MIXER. Thus, a toner 1 is prepared.

(Fixing Test)

The toner 1 is set in an image forming apparatus IPSIO C220 (from Ricoh Co., Ltd.). An A4 TYPE 6200 (Y) paper (from Ricoh Co., Ltd.) is longitudinally passed through the IPSIO C220 so that the IPSIO C220 produces an unfixed solid zone image having a width of 36 mm with the toner 1 to have a toner weight of 10 g/m$^2$, leaving a margin having a width of 5 mm at the leading end of the paper. Then, the margin is cut at a width of 6 mm to prepare an unfixed solid zone image without a margin at the leading end.

Next, in the IPSIO C220, the genuine fuser roller is replaced with another fuser roller as illustrated in FIG. 3 (comprised of an aluminum metal core 611 with an inner diameter of 29.0 mm and an elastic silicone rubber layer 612 defining an undulating surface having convex portions 61*a* having a thickness of 1.7 mm and concave portions 61*b* having a thickness of 1.4 mm forming a sinusoidal cross-section with a cycle of 60 mm, and a PFA release layer 613), and the genuine pressure roller is replaced with another pressure roller as illustrated in FIG. 4 (comprised of an aluminum metal core 621 with an inner diameter of 29.0 mm and an elastic silicone rubber layer 622 defining an undulating surface having convex portions 62*a* having a thickness of 1.7 mm and concave portions 62*b* having a thickness of 1.4 mm forming a sinusoidal cross-section with a cycle of 60 mm, and a PFA release layer 623).

The unfixed solid zone image is passed through the fixing nip defined with the above-described fuser and pressure rollers while setting the revolution and surface temperature of the fuser roller to 6.8 rad/s and 160±2° C. As a result, the paper never winds around the fuser roller.

In the resulting fixed image, significant stripe-patterned gloss unevenness is not observed. The gloss level is proper and the printing quality is good.

Example 2

The pigment-wax dispersion 1 and the aqueous medium 1 are prepared again in the same manner as Example 1.

Next, 975 parts of the pigment-wax dispersion 1 and 7.5 parts of isophorone diamine are mixed with a TK HOMOMIXER (from PRIMIX Corporation) for 1 minute at a revolution of 5,000 rpm. Next, 173 parts of the isocyanate-modified polyester 1 and 116 parts of the isocyanate-modified polyester 2 are mixed therein with a TK HOMOMIXER (from PRIMIX Corporation) for 1 minute at a revolution of 5,000 rpm. Further, 1,200 parts of the aqueous medium 1 are mixed therein with a TK HOMOMIXER for 20 minutes at a revolution of from 8,000 to 13,000 rpm. Thus, an emulsion slurry 2 is prepared.

Thereafter, the procedure for preparation of the toner 1 in Example 1 is repeated except for replacing the emulsion slurry 1 with the emulsion slurry 2. Thus, a toner 2 is prepared.

The toner 2 is subjected to the fixing test in the same manner as Example 1. As a result, the degree of stripe-patterned gloss unevenness is much lower (i.e., better) than Example 1. The gloss is slightly lower than Example 1 but the printing quality is good.

Example 3

(Preparation of Pigment-Wax Dispersion 3)

A vessel equipped with a stirrer and a thermometer is charged with 540 parts of the unmodified polyester 1, 49 parts of a paraffin wax (having a melting point of 74° C.), and 920 parts of ethyl acetate. The mixture is heated to 80° C. while being agitated and kept at 80° C. for 5 hours, followed by cooling to 30° C. over a period of 1 hour. Subsequently, 293 parts of the master batch 1 and 100 parts of ethyl acetate are further added to the vessel and the mixture is agitated for 1 hour. Thus, a raw material liquid 3 is prepared.

Next, 1,800 parts of the raw material liquid 3 are contained in a vessel and subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Further, 1,200 parts of a 60% ethyl acetate solution of the unmodified polyester 1 and 90 parts of ethyl acetate are added to the vessel and the mixture is subjected to the above dispersion treatment again except for changing the repeat number of dispersion operation to 1 time. Thus, a pigment-wax dispersion 3 is prepared. An appropriate amount of ethyl acetate is added to the pigment-wax dispersion 3 so that the solid content becomes 50% by weight.

(Preparation of Aqueous Medium 1)

An aqueous medium 1 is prepared by mixing 970 parts of ion-exchange water, 40 parts of a 25% aqueous solution of an organic particulate resin (a copolymer of styrene, methacrylic acid, butyl acrylate, and sodium salt of sulfate ester of ethylene oxide adduct of methacrylic acid), 140 parts of a 48.5% aqueous solution of dodecyl diphenyl ether sodium disulfonate, and 90 parts of ethyl acetate.

(Emulsification)

First, 975 parts of the pigment-wax dispersion 3 and 7.5 parts of isophorone diamine are mixed with a TK HOMOMIXER (from PRIMIX Corporation) for 1 minute at a revolution of 5,000 rpm. Next, 124 parts of the isocyanate-modified polyester 1 and 31 parts of the isocyanate-modified polyester 2 are mixed therein with a TK HOMOMIXER (from PRIMIX Corporation) for 1 minute at a revolution of 5,000 rpm. Further, 1,200 parts of the aqueous medium 1 are mixed therein with a TK HOMOMIXER for 20 minutes at a revolution of from 8,000 to 13,000 rpm. Thus, an emulsion slurry 3 is prepared.

Thereafter, the procedure for preparation of the toner 1 in Example 1 is repeated except for replacing the emulsion slurry 1 with the emulsion slurry 3. Thus, a toner 3 is prepared.

The toner 3 is subjected to the fixing test in the same manner as Example 1. As a result, stripe-patterned gloss unevenness is slightly observed, but there is no problem in practical use. The gloss is proper and the printing quality is good.

Example 4

(Preparation of Cyan Pigment Dispersion)

A cyan pigment dispersion is prepared by dispersing 50 parts of a cyan pigment (C. I. Pigment Blue 15:3) and 10 parts sodium dodecyl sulfate in 200 parts of ion-exchange water using a sand grinder mill. The resultant cyan pigment dispersion contains cyan pigment particles having a volume average particle diameter (D50) of 170 nm.

(Preparation of Latex 1HML)

1) First Step Polymerization (Preparation of Core Particles)

A monomer solution 1 is prepared by mixing 568.00 parts of styrene, 162.00 parts of n-butyl acrylate, 68.00 parts of methacrylic acid, 2.00 parts of 1,6-hexanediol diacrylate, and 16.51 parts of n-octyl mercaptan.

A dispersion medium 1 is prepared by dissolving 4.05 parts of sodium dodecyl sulfate in 2,500.00 parts of ion-exchange water.

A 5,000-ml separable flask equipped with a stirrer, a thermometer, a condenser, and a nitrogen inlet pipe is charged with the dispersion medium 1 and heated to 80° C. while agitating the dispersion medium 1 at a revolution of 230 rpm under nitrogen gas flow. Thus, an activator solution is prepared.

An initiator solution in which 9.62 parts of a polymerization initiator (potassium persulfate) are dissolved in 200 parts of ion-exchange water is added to the activator solution. Further, the monomer solution 1 is dropped therein over a period of 90 minutes. The mixture is heated to 80° C. for 2 hours while being agitated so as to polymerize the monomers. (This process is what is called the first step polymerization.) Thus, a latex 1H is prepared. The latex 1H contains core particles having a weight average particle diameter of 68 nm.

2) Second Step Polymerization

A flask equipped with a stirrer is charged with 123.81 parts of styrene, 39.00 parts of n-butyl acrylate, 12.29 parts of methacrylic acid, 0.70 parts of 1,6-hexanediol diacrylate, 0.72 parts of n-octyl mercaptan, 5.0 parts of an ester wax (ELECTOR® WEP-2 from NOF Corporation), and 10.0 parts of a paraffin wax (HNP-9 from Nippon Seiro Co., Ltd.) and heated to 80° C. Thus, a monomer solution 2 is prepared.

A dispersion medium 2 is prepared by dissolving 0.60 parts of a surfactant represented by $C_{10}H_{21}(OCH_2CH_2)_2OSO_3^-Na^+$ in 2,700.00 parts of ion-exchange water.

The dispersion medium 2 is heated to 98° C. and 32 parts on solid basis of the latex 1H are added thereto. Thereafter, the monomer solution 2 is dispersed therein over a period of 8 hours using a mechanical disperser CLEARMIX (from M Technique Co., Ltd.) having a circulation path. Thus, a dispersion containing oil droplets (i.e., an emulsion) is prepared.

An initiator solution in which 6.12 parts of a polymerization initiator (potassium persulfate) are dissolved in 250 parts of ion-exchange water is added to the dispersion (emulsion). The mixture is heated to 82° C. for 12 hours while being agitated so as to polymerize the monomers. (This process is what is called the second step polymerization.) Thus, a latex 1HM is prepared.

3) Third Step Polymerization

A monomer solution is prepared by mixing 355 parts of styrene, 95 parts of n-butyl acrylate, and n-octyl mercaptan in an amount 1.2% by mole of the styrene and n-butyl acrylate.

An initiator solution is prepared by mixing 40 parts of an 8% aqueous solution of hydrogen peroxide and 40 parts of an 8% aqueous solution of ascorbic acid.

The monomer solution and the initiator solution are dropped in the latex 1HM over a period of 6 hours at 82° C., and the mixture is kept at 82° C. for 2 hours while being agitated so as to polymerize the monomers. (This process is what is called the third step polymerization.) Thus, a latex 1HML is prepared.

The third step polymerization product is formed from monomers having no anionic functional group and the polymerization initiator.

(Preparation of Toner Particles)

A four-neck flask equipped with a thermometer, a condenser, a nitrogen inlet pipe, and a stirrer is charged with 420.0 parts on solid basis of the latex 1HML, 900 parts of ion-exchange water, and 150 parts of the cyan pigment dispersion. After setting the inner temperature to 30° C., a 5N water solution of sodium hydroxide is added thereto so that the mixture has a pH of from 8 to 10.0.

A water solution in which 9.0 parts of aluminum sulfate are dissolved in 900 parts of ion-exchange water is further added thereto over a period of 10 minutes at 30° C. After leaving for 3 minutes, the resultant mixture is heated to 92° C. so as to induce aggregation. The particle diameter of aggregated particles in the resulting mixture is continuously monitored by a particle size analyzer COULTER COUNTER TA-II (from Beckman Coulter, Inc.). At a time the number average particle diameter becomes 6.1 μm, the aggregation is terminated by adding a water solution in which 80.4 parts of sodium chloride are dissolved in 1,000 parts of ion-exchange water.

Subsequently, the mixture is heated to 94° C. and agitated so as to accelerate fusion of the aggregated particles and phase-separation of crystalline materials. The shape of the fused particles is continuously monitored by a flow particle image analyzer FPIA-2000 (from Sysmex Corporation). At a time the shape factor becomes 0.960, the mixture is cooled to 30° C. and the agitation is stopped.

After filtration, the resultant fused particles are repeatedly washed with ion-exchange water at 45° C. and dried with hot air at 40° C. Thus, a mother toner 4 is prepared. The mother toner 4 has a number average particle diameter of 6.0 μm and a shape factor of 0.962.

Thereafter, the procedure for preparation of the toner 1 in Example 1 is repeated except for replacing the mother toner 1 with the mother toner 4. Thus, a toner 4 is prepared.

The toner 4 is subjected to the fixing test in the same manner as Example 1. As a result, significant stripe-patterned gloss unevenness is not observed. The gloss level is proper and the printing quality is good.

Comparative Example 1

The pigment-wax dispersion 3 and the aqueous medium 1 are prepared again in the same manner as Example 3.

Next, 977 parts of the pigment-wax dispersion 3 and 7.5 parts of isophorone diamine are mixed with a TK HOMOMIXER (from PRIMIX Corporation) for 1 minute at a revolution of 5,000 rpm. Next, 155 parts of the isocyanate-modified polyester 1 are mixed therein with a TK HOMOMIXER (from PRIMIX Corporation) for 1 minute at a revolution of 5,000 rpm. Further, 1,200 parts of the aqueous medium 1 are mixed therein with a TK HOMOMIXER for 20 minutes at a revolution of from 8,000 to 13,000 rpm. Thus, an emulsion slurry 101 is prepared.

Thereafter, the procedure for preparation of the toner 1 in Example 1 is repeated except for replacing the emulsion slurry 1 with the emulsion slurry 101. Thus, a toner 101 is prepared.

The toner 101 is subjected to the fixing test in the same manner as Example 1. As a result, significant stripe-patterned gloss unevenness is observed.

Comparative Example 2

The pigment-wax dispersion 1 and the aqueous medium 1 are prepared again in the same manner as Example 1.

Next, 975 parts of the pigment-wax dispersion 1 and 7.5 parts of isophorone diamine are mixed with a TK HOMO- MIXER (from PRIMIX Corporation) for 1 minute at a revolution of 5,000 rpm. Next, 115 parts of the isocyanate-modified polyester 1 and 173 parts of the isocyanate-modified polyester 2 are mixed therein with a TK HOMOMIXER (from PRIMIX Corporation) for 1 minute at a revolution of 5,000 rpm. Further, 1,200 parts of the aqueous medium 1 are mixed therein with a TK HOMOMIXER for 20 minutes at a revolution of from 8,000 to 13,000 rpm. Thus, an emulsion slurry 102 is prepared.

Thereafter, the procedure for preparation of the toner 1 in Example 1 is repeated except for replacing the emulsion slurry 1 with the emulsion slurry 102. Thus, a toner 102 is prepared.

The toner 102 is subjected to the fixing test in the same manner as Example 1. As a result, significant stripe-patterned gloss unevenness is not observed, but the gloss is too low to be used practically. A part of the fuser roller is contaminated with toner particles and the image is partially defected. Toner particles easily release from the paper when the image is rubbed with a finger.

The above-prepared toners are further subjected to the following evaluations.

A) Measurement of Loss Elastic Modulus G"(100) and G"(150)

Each of the toners is compression-molded into a disk-shaped specimen having a diameter of 1.0 mm and a thickness of 2.5±0.3 mm at a temperature of 25° C. and a pressure of 30 MPa. The compression time is 30 sec.

The disk-shaped specimen is set to a parallel plate of a rotating flat plate rheometer PheoPlus (from Anton Paar GmbH). The temperature is set to 100° C. The measurement position is set to 0.1 mm above the disk-shaped specimen in the thickness direction. After the normal force is gradually reduced to a constant value, the temperature is increased to 140° C. The measurement position is reset so as to be coincident with the thickness of the disk-shaped specimen. After arranging the shape of the disk-shaped specimen, the temperature is reduced to 50° C. (i.e., the measurement starting temperature) to start the measurement of elastic modulus at 100° C. (G"(100)) and 150° C. (G"(150)).

The measurement mode is "automatic", the frequency is 1 Hz, and the initial strain is 0.1%. During the measurement, the temperature is increased from 50° C. to 220° C. at a heating rate of 2° C./min.

B) Gloss Unevenness

The fixed images are visually observed to evaluate gloss unevenness and graded into the following 3 levels.

A: Significant gloss unevenness is not observed.

B: Gloss unevenness is observed, but is allowable for practical use.

C: Significant gloss unevenness is observed. Not allowable for practical use.

C) Gloss Level

The fixed images are visually observed to evaluate gloss level and graded into the following 3 levels.

A: The gloss level is appropriate.

B: The gloss level is slightly low. The image is matte but the printing quality is allowable.

C: The gloss level is significantly low. Not allowable for practical use.

The evaluation results are shown in Table 1.

TABLE 1

| | Loss Elastic Modulus | | | Gloss | Gloss |
|---|---|---|---|---|---|
| | G"(100) | G"(150) | G"(100)/G"(150) | Unevenness | Level |
| Example 1 | 67,000 | 4,800 | 14.0 | A | A |
| Example 2 | 78,000 | 6,300 | 12.4 | A | B |
| Example 3 | 49,000 | 2,500 | 19.6 | B | A |
| Example 4 | 57,000 | 4,110 | 13.9 | A | A |
| Comparative Example 1 | 29,000 | 1,200 | 24.2 | C | A |
| Comparative Example 2 | 93,000 | 8,200 | 11.3 | A | C |

Having now fully described the invention, it will be apparent to one of ordinary skill in the art that many changes and modifications can be made thereto without departing from the spirit and scope of the invention as set forth therein.

What is claimed is:

1. An image forming method, comprising:

forming a toner image on a recording medium with a toner comprising a resin and a colorant; and fixing the toner image on the recording medium by passing the recording medium through a fixing nip defined between a first member and a second member under heat and pressure, wherein a loss elastic modulus at 100° C. (G"(100)) of the toner is less than 80,000 Pa·s, and a ratio (G"(100)/G"(150)) of the loss elastic modulus at 100° C. (G"(100)) to a loss elastic modulus at 150° C. (G"(150)) of the toner is from 1 to 20;

wherein the first member extends along a first longitudinal axis, and has a first elastic layer whose thickness varies along the first longitudinal axis to define at least one first convex portion curving outward and at least one first concave portion curving inward with respect to the first longitudinal axis;

wherein the second member extends along a second longitudinal axis, and has a second elastic layer whose thickness varies along the second longitudinal axis to define at least one second convex portion curving outward and at least one second concave portion curving inward with respect to the second longitudinal axis; and wherein at least one of the first and second members is heated, and at least one of the first and second members is pressed against the other, with the first convex portion engaging the second concave portion and the first concave portion engaging the second convex portion, to define the fixing nip therebetween.

2. The image forming method according to claim 1, wherein the corresponding convex and concave portions contact each other with no space therebetween in a no-load state in which the first and second members contact each other with substantially no pressure applied to either member.

3. The image forming method according to claim 1, wherein the first convex portions and the first concave portions are contiguous along the first longitudinal axis, and the second convex portions and the second concave portions are contiguous along the second longitudinal axis.

4. The image forming method according to claim 1, wherein a total thickness of the first and second elastic layers between the first and second members is substantially constant at every point along the longitudinal axes in a no-load state in which the first and second members contact each other with substantially no pressure applied to either member.

5. The image forming method according to claim 1, wherein each of the first and second members has a series of convex and concave portions entirely spanning maximum width of recording medium that the fixing device can accommodate through the fixing nip.

6. The image forming method according to claim 1, wherein each of the first and second members has a series of convex and concave portions partially spanning maximum width of recording medium that the fixing device can accommodate through the fixing nip.

7. The image forming method according to claim 1, wherein the first convex portion and the second concave portion are partially straight along the respective longitudinal axes.

8. The image forming method according to claim 1, wherein the first concave portion and the second convex portion are partially straight along the respective longitudinal axes.

9. The image forming method according to claim 1, wherein each of the first and second elastic layers has a difference between maximum and minimum thickness along the longitudinal axis of the first member in a range of approximately 0.16 mm to approximately 0.8 mm in a load state in which the first and second members are pressed against each other.

10. The image forming method according to claim 1, wherein the first member comprises an internally heated fuser roller rotatable around the first longitudinal axis, and the second member comprises a pressure roller pressed against the fuser roller for rotation around the second longitudinal axis.

11. The image forming method according to claim 1, wherein the first member comprises an internally heated fuser roller rotatable around the first longitudinal axis, and the second member comprises a stationary pressure member pressed against the fuser roller through an endless fixing belt looped for rotation around the pressure member.

12. The image forming method according to claim 1, wherein the first and second members have one pair of adjacent longitudinal ends in alignment with each other, and the other pair of adjacent longitudinal ends displaceable along the respective longitudinal axes.

* * * * *